US011479456B2

(12) United States Patent
Wood et al.

(10) Patent No.: US 11,479,456 B2
(45) Date of Patent: Oct. 25, 2022

(54) GAS DISPENSING SYSTEM FOR A BEVERAGE MACHINE

(71) Applicant: BEDFORD SYSTEMS LLC, Bedford, MA (US)

(72) Inventors: Barry Wood, Norwood, MA (US); Travis Nevers, Tewksbury, MA (US); Enrico Raffaele Cafaro, Beverly, MA (US)

(73) Assignee: Bedford Systems, LLC, Bedford, MA (US)

( * ) Notice: Subject to any disclaimer, the term of this patent is extended or adjusted under 35 U.S.C. 154(b) by 595 days.

(21) Appl. No.: 16/362,512

(22) Filed: Mar. 22, 2019

(65) Prior Publication Data

US 2019/0292034 A1 Sep. 26, 2019

Related U.S. Application Data

(60) Provisional application No. 62/646,821, filed on Mar. 22, 2018, provisional application No. 62/646,830, filed on Mar. 22, 2018.

(51) Int. Cl.
*B67D 1/00* (2006.01)
*B67D 1/04* (2006.01)

(52) U.S. Cl.
CPC ..... *B67D 1/0059* (2013.01); *B67D 1/007* (2013.01); *B67D 1/008* (2013.01); *B67D 1/0418* (2013.01)

(58) Field of Classification Search
CPC ..... B67D 1/008; B67D 1/0059; B67D 1/0057–0077; B67D 1/0418; A47J 31/00; A47J 31/407; F17C 13/06; F17C 13/084
(Continued)

(56) References Cited

U.S. PATENT DOCUMENTS 4,344,410 A * 8/1982 Curran ..... F41B 11/62 124/74
5,329,975 A 7/1994 Heitel
(Continued)

FOREIGN PATENT DOCUMENTS

AU 2011101498 A4 12/2011
CN 203474432 U 3/2014
(Continued)

OTHER PUBLICATIONS

English machine translation of Hirotsugu (JPH01220800) (Year: 1989).*

(Continued)

*Primary Examiner* — Andrew D StClair
(74) *Attorney, Agent, or Firm* — Dorsey & Whitney LLP

(57) ABSTRACT

A gas dispensing system for a beverage system is disclosed herein. The gas dispensing system can releasably secure a gas canister or other gas source for release of pressurized gas therein to the beverage system. In an embodiment, the gas dispensing system includes a distribution body that can articulate between a loading position and a dispensing position. In the loading position, a gas canister can be releasably secured within the system. As the distribution body is moved into the dispensing position, a puncture mechanism can be moved further into the distribution body, puncturing the gas canister for release of pressurized gas. The distribution body can be fluidically coupled with a valve or other flow control element of the beverage machine, allowing for controlled entry of the pressurized gas into the system.

14 Claims, 17 Drawing Sheets

(58) Field of Classification Search
USPC ..... 137/68.3
See application file for complete search history.

(56) References Cited

U.S. PATENT DOCUMENTS

| | | | | |
|---|---|---|---|---|
| 6,843,388 | B1 * | 1/2005 | Hollars | F17C 13/06 222/183 |
| 9,409,759 | B2 * | 8/2016 | Wilder | A47J 31/60 |
| 2011/0049193 | A1 | 3/2011 | Muller et al. | |
| 2013/0214011 | A1 | 8/2013 | Vandekerckhove et al. | |
| 2014/0239522 | A1 * | 8/2014 | An | B01F 3/04808 261/121.1 |
| 2015/0044343 | A1 | 2/2015 | Leung et al. | |
| 2015/0225221 | A1 | 8/2015 | Wilder et al. | |
| 2015/0329341 | A1 | 11/2015 | Wilder et al. | |

FOREIGN PATENT DOCUMENTS

| | | | |
|---|---|---|---|
| CN | 104819380 | A | 8/2015 |
| CN | 105705457 | A | 6/2016 |
| JP | H01220800 | A | 9/1989 |
| JP | 2003146393 | A | 5/2003 |
| JP | 2012217984 | A | 11/2012 |

OTHER PUBLICATIONS

International Search Report and Written Opinion for International Application No. PCT/US2019/023544 dated Jul. 4, 2019.
Extended European Search Report for EP Application No. 19772186.3 dated Nov. 10, 2021.

* cited by examiner

GAS DISPENSING SYSTEM FOR A BEVERAGE MACHINE

CROSS-REFERENCE TO RELATED APPLICATIONS

The patent application is a nonprovisional patent application of and claims priority to U.S. Provisional Patent Application No. 62/646,830 filed Mar. 22, 2018, and titled "Articulating Connection to Carbonation Source in a Beverage System," and U.S. Provisional Patent Application No. 62/646,821 filed Mar. 22, 2018, and titled "Carbonation Source Connector in a Beverage Dispensing System," the disclosures of which are hereby incorporated herein by reference in their entities.

FIELD

The present disclosure relates to a beverage machine, and more particularly to a gas dispensing system for a beverage machine.

BACKGROUND

Carbonated beverage machines generally include a carbonation system that dissolves gas (e.g., carbon dioxide) in a liquid (e.g., water) to prepare a carbonated beverage. This can involve integrating and attaching a gas source to a beverage machine. Many traditional systems suffer from significant drawbacks that can contribute to inadequate installation and removable mechanisms for carbonation canisters. As such, the need continues for systems and techniques that facilitate safe, reliable, and repeatable carbonation source connection to a beverage machine.

SUMMARY

Systems and methods are generally described herein related to beverage appliances and associated gas dispensing systems. In an embodiment, a gas dispensing system for a beverage machine is disclosed. The gas dispensing system includes an articulation mechanism fixed to the beverage machine. The gas dispensing system further includes a distribution body configured to direct pressurized gas from a gas canister and to the beverage machine. The distribution body can be engaged with the articulation mechanism for articulation between a loading position and a dispensing position. The gas dispensing system can be configured to release pressurized gas from the gas canister when the distribution body is in the dispensing position.

In another embodiment, the distribution body can define a series of lumens. In this regard, a first lumen of the series of lumens can be configured to receive pressurized gas from the gas canister. Further, a second lumen of the series of lumens can be configured to transfer pressurized gas from the distribution body and toward the beverage machine. In some cases, the articulation mechanism can define a pivot axis and the distribution body is engaged with the articulation mechanism to pivot about the pivot axis. In this regard, the second lumen can be arranged substantially along the pivot axis and the first lumen can extend substantially radially from the pivot axis. Further, a third lumen of the series of lumens can be arranged to provide a visual indication of pressurization within the distribution body.

In another embodiment, the gas canister can be releasably associated with the distribution body via a receiving coupler. Additionally, the gas dispensing system can further include a puncture mechanism coupled with the distribution body. The puncture mechanism can include a puncture element extending partially into the distribution body and substantially aligned with a gas canister associated with the gas dispensing system.

In another embodiment, the puncture element can be movable toward the gas canister in response to articulation of the distribution body from the loading position to the dispensing position. In some cases, the articulation mechanism can define a cam path. A portion of the puncture element can extend from the distribution body, engaging the cam path. Accordingly, articulation of the distribution body from the loading position to the dispensing position can cause the portion of the puncture element to follow the cam path, moving the puncture element toward the gas canister.

In another embodiment, a method of installing a canister in a beverage machine is disclosed. The method includes associating a gas canister with a distribution body in a loading position. The method further includes articulating the distribution body relative to an articulation mechanism fixed within the beverage machine. This moves the gas canister into a dispensing position for release of pressurized gas held within the canister.

In another embodiment, the method can further include puncturing the gas canister in response to the moving of the gas canister into the dispensing position. In some cases, the operation of puncturing includes engaging a slideable puncture element along a cam path defined by the articulation mechanism. The slideable puncture element can slide within the distribution body and the cam path can guide the puncture element toward the gas canister during the operation of articulating.

In another embodiment, the operation of associating further includes threading the gas canister and distribution body with one another. In this regard, the operation of threading can further include using a receiving coupler to define an interface between the distribution body and the gas canister.

In another embodiment, a gas dispensing system for a beverage machine is disclosed. The gas dispensing system includes a distribution body defining a receiving coupler for releasably associating a gas canister. The distribution body can be configured to articulate between a loading position and a dispensing position, maintaining the association of the gas canister. The gas dispensing system can further include a puncture mechanism coupled with the distribution body and configured to puncture the gas canister in response to the gas canister being in the dispensing position.

In another embodiment, the receiving coupler can define threads configured to thread the gas canister and the distribution body to one another. In some cases, the gas dispensing system can further include an engagement coupler connected to or configured to be connected to the gas canister. The engagement coupler and the receiving coupler can cooperate to establish a sealed connection between the gas canister and the distribution body.

In another embodiment, the gas canister can release pressurized gas into the distribution body in response to being punctured by the puncture mechanism. In this regard, the system can further include a valve fluidically connected with the distribution body and configured to regulate flow of the pressurized gas into the beverage machine. The distribution body and the valve can be fluidically connected at a lumen. The distribution body can be configured to pivot about an axis substantially defined by the lumen.

In another embodiment, gas dispensing system can further include an articulation mechanism defining a series of apertures. The distribution body can further include a series of protrusions, with each protrusion extending through respective ones of the series of apertures. In this regard, the series of apertures and the series of protrusions can cooperate to establish the articulation of the distribution body between the loading position and the dispensing position.

In another embodiment, various other articulating gas dispensing mechanisms are disclosed. For example, a carbonation source connector system can include an engagement coupler having an engagement wall with an internal surface and external surface that defines an opening from a first end of the engagement coupler to a second end of the engagement coupler. The opening is suitable to receive a dispensing end of a carbonation canister. The engagement coupler can also include a plurality of engagement tabs extending in a plurality of radial directions from the exterior surface of the engagement wall. The carbonation source connector system can also include a receiving coupler having a receiving wall with an internal surface and external surface that define an opening from a first end of the receiving coupler to a second end of the receiving coupler. The internal wall can have a plurality of shelves formed thereon that are configured to support the engagement tabs. The receiving coupler can also have a clearance portion on the internal surface of the wall defined by a larger radial distance at the opening than at the shelf and sufficiently large to allow the engagement coupler and plurality of engagement tabs to pass into the opening. The shelf can extend from the clearance portion in such a way as to allow the engagement tab to rest on the shelf by rotating the engagement connector.

In another embodiment, the carbonation source connector system can also include a distribution body. The engagement coupler and receiving coupler connect the canister to the distribution body. The receiving coupler is received into a first end of the distribution body. At least a portion of the engagement coupler, receiving coupler, and the distribution body articulates via a pivot joint such that a canister attached thereto is able to swing due to the pivot. The connector can move longitudinally into and out of the distribution body as the receiving coupler articulates. The receiving coupler and the distribution body can both be supported by a bracket. The distribution body can be pivotably supported by the bracket via the pivoting joint and the receiving coupler is supported by a cam path on the bracket. The carbonation source connector system can also include a canister that is threadably engaged with the engagement coupler.

In another embodiment, a receiving coupler for connecting a carbonation source to a distribution body can include a wall having an internal surface that defines an opening from a first end of a coupler to a second end of the coupler, the opening being suitable to receive a dispensing end of a carbonation canister. The receiving coupler can also include a shelf formed on the internal surface of the wall. The shelf is configured to support engagement tabs extending from a carbonation canister, such that the carbonation canister can be suspended from the shelf. The receiving coupler can also include a clearance portion on the internal surface of the wall defined by a larger radial distance at the opening than at the shelf. The radial distance is sufficiently large to allow the carbonation canister and the engagement tab to pass into the opening. The shelf extends from the clearance portion in such a way as to allow the engagement tab to rest on the shelf in response to rotating the carbonation canister once the engagement tab is far enough along the clearance portion and through the opening to pass the shelf.

In another embodiment, the wall is an annular wall with a plurality of shelves and clearance portions formed on the internal surface and suitable to engage a plurality of corresponding engagement tabs. The shelf can extend as a ramp from the first end to the second end along a portion of the internal surface. The shelf can include a trough along the shelf on the internal surface with the trough suitable to form a detent for the carbonation canister. The receiving coupler can also include external supports of suitable strength to support the carbonation canister in a beverage dispensing system. The external supports are protrusions that extend from opposing sides of the wall, with the protrusions suitable to function as followers for engaging in a cam path.

In another embodiment, an engagement coupler can include a wall having an internal surface that defines an opening from a first end of the engagement coupler to a second end of the coupler. The opening is suitable to receive a dispensing end of a carbonation canister. Support tabs can extend in a plurality of directions from the exterior surface of the wall. The support tabs can be configured to support the weight of the carbonation canister and engage support surfaces in a receiving coupler.

In another embodiment, the engagement coupler can include an internal engagement mechanism for coupling the interior surface of the wall to the carbonation canister. The internal engagement mechanism can include an interior threaded surface. The support tabs can be U-shaped. The support tabs have the open end of the U-shape toward the dispensing end of the engagement coupler. The support tabs extend from opposing radial sides. The first end is bell-shaped to extend around a profile of a carbonation canister.

In another embodiment, various other articulating gas dispensing mechanisms are disclosed. For example, a carbonation supply system can include a distribution body having a wall defining a lumen connecting a first opening to a second opening. The first opening is configured to receive a pressurized gas from a carbonation source. The second opening is configured to direct the pressurized gas to a valve body. The distribution body is supported such that the first opening is movable relative to the second opening allowing for an articulation of the first opening and the carbonation source.

In another embodiment, the lumen includes a receiving portion and a dispensing portion. The receiving portion and the dispensing portion intersect one another. The dispensing portion of the lumen extends to the second opening with the dispensing portion of the lumen and the second opening operable to rotate about an axis. The axis defines a longitudinal centerline of the dispensing portion and the dispensing portion is configured to rotate about the axis. The first opening translates radially about the axis. The distribution body supports the carbonation source.

In another embodiment, the supply system also includes a bracket that supports the distribution body. The distribution body is rotatably supported within the bracket. The first opening and the carbonation source articulate between a first position and a second position. In the first position, the first opening is translated outwardly away from the bracket and is connected to the carbonation source. The second position allows for dispensing of the pressurized gas from the carbonation source.

In another embodiment, the carbonation source is a canister containing the pressurized gas, and the articulation mechanism causes the canister to rotate radially around the axis. The supply system can also include a connector that connects the canister to the distribution body. The connector includes a receiving coupler that is received into a first end of the distribution body. At least a portion of the connector or the distribution body articulates with the canister. The connector can move longitudinally into and out of the distribution body as the connector articulates radially about the axis with the canister. The receiving coupler and the distribution body can both be supported by a bracket. The distribution body is pivotably supported by a bracket and the receiving coupler is supported by a cam path on the bracket. The cam path is shaped such that as the distribution body is rotated into the dispensing position, the cam path applies pressure on the receiving coupler causing it to be drawn into an inner chamber of the distribution body and seating the canister therein against a seal, forming a pressurized seal between the canister and the distribution body.

In another embodiment, the supply system can also include a pressure interlock that interacts with the distribution body, such that above a pressure threshold the pressure interlock limits or prevents articulation of the first opening relative to the second opening, and below the pressure threshold, the pressure interlock allows articulation of the first opening relative to the second opening. The pressure interlock can be positioned in an interlock lumen that extends from the receiving or the dispensing lumen. The pressure interlock limits or prevents articulation in response to pressure in the lumen reaching or exceeding a threshold. The supply system can also include a bracket that supports the distribution body with the distribution body being rotatably supported within the bracket. The pressure interlock forms an engagement between the bracket and the distribution body to limit or prevent articulation between the two. The pressure interlock can include a pin that occupies the interlock lumen. An increase in pressure causes the pin to translate within the interlock lumen. A portion of the pin can extend out of the distribution body at least in response to being above the pressure threshold, such that the pin engages with the bracket and the interlock lumen at the same time, limiting or preventing articulation of the first opening relative to the second opening. A spring having a spring force can bias the pin into the distribution body. The spring force sets the pressure threshold such that in response to the pressure in the lumen overcoming the spring force, the pin translates sufficiently to engage the bracket.

In another embodiment, the supply system also includes a release mechanism that releases the pressurized gas as the carbonation source articulates from the first position to the second position. The lumen includes a receiving portion and a dispensing portion that can intersect one another with the dispensing portion of the lumen extending to the second opening. The dispensing portion of the lumen and the second opening are operable to rotate about an axis and the first opening translates radially about the axis. The carbonation source is a pressurized canister. The distribution body can support the canister and a bracket that supports the distribution body. The release mechanism pierces the canister to release the pressurized gas. The release mechanism includes a pin that pierces the canister to release the pressurized gas. The pin is located in a piercing channel that intersects with and is in fluid communication with at least one of the receiving lumen and the distribution lumen such that in response to piercing the canister the receiving lumen and the distribution lumen are pressurized.

As the canister articulates, the pin translates along the piercing channel until it engages with the canister. The pin includes a first end and a second end, the first end being sharp for piercing the canister and second end suitable to follow a cam path. The bracket includes a cam path and the pin extends out of the distribution body and contacts the cam path. The cam path includes a first portion that correlates with the position of the pin when the canister is rotated outward into a loading position. This first portion of the cam path is at a sufficient distance from the canister such that the first portion does not force the pin into the canister. The cam path includes a second portion that correlates with the position of the pin when the canister is articulating between the loading position and a dispensing position. This second portion of the cam path includes a range of distances that begin to cause the pin to engage the canister as the canister and pin rotate. The cam path can include a max pressure portion that correlates with the position of the pin when the canister is substantially all the way to dispensing position, the max pressure portion being the smallest distance between where the pin pierces the canister and the cam path. The cam path can include a detent portion that is farther from where the pin pierces the canister, such that the max portion of the cam surface is correlated with the location of the pin when the canister is in the dispensing position.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

Figure 1:
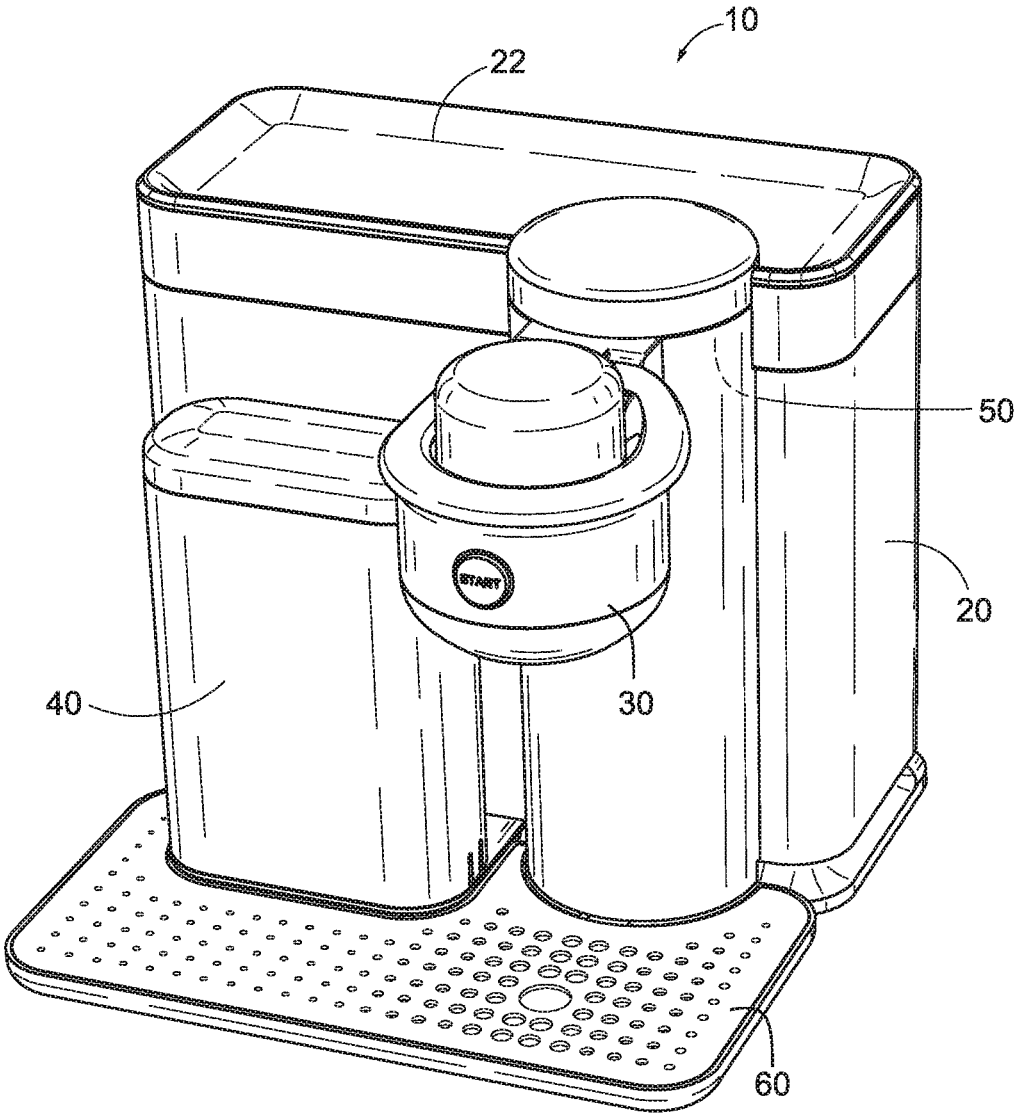
FIG. 1 is an isometric view of a beverage dispensing system.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative aspects, embodiments, and examples described in the detailed description and drawings, are not meant to be limiting. Other examples can be utilized, and other changes can be made, without departing from the spirit or scope of the subject matter presented herein. The various embodiments can stand alone or be combined with the other embodiments disclosed herein. It will be readily understood that the aspects of the present disclosure, as generally described herein and illustrated in the Figures, can be arranged, substituted, combined, separated, and designed in a wide variety of different configurations, all of which are implicitly contemplated herein.

In accordance with various aspects of the embodiments herein, a beverage dispensing system includes a fluid source (such as water, water vapor, or other) and a gas source. In some instances the beverage dispensing system can also include a secondary additive source such as flavoring and/or alcohol. The beverage dispensing system dissolves the gas in the fluid source to form a constituent (e.g., a mixture that can also be mixed with other flavors or ingredients) or the entirety of the end beverage. The term "carbonation" or "carbonated" is used herein to generically refer to that gas source and beverages that have a dissolved gas respectively, and thus refers to a sparkling beverage whether the dissolved gas is carbon dioxide, nitrogen, oxygen, air, or another gas or mixture of gases. Thus, the principles disclosed herein are not limited to forming beverages that have a dissolved carbon dioxide content, but rather can include other suitable dissolved gas. In one example, the carbonated fluid formed by the beverage dispensing system is mixed with ingredients introduced to the system via a pod mechanism that releases different ingredients from a variety of different pods depending on what pod the user places in the machine for a single drink dispensing operation. In a more particular example, the pod is an alcoholic mix designed to be mixed with carbonated water and then dispensed.

In accordance with the various aspects and embodiments discussed herein, the beverage dispensing system includes a cartridge that contains the gas source. In various embodiments, the gas source cartridge is connected to the beverage dispensing system and a portion of the beverage dispensing system articulates. For example, the cartridge itself can articulate between a cartridge replacement position, a position that provides greater access to the cartridge by the user, and a cartridge dispensing position, a position that allows for secure dispensing of the pressurized gas from the cartridge. In various embodiments, a portion of the dispensing system articulates and as the system articulates, the system gradually moves a piercing device into the canister to release the pressurized gas from the canister. In various embodiments, the beverage dispensing system includes a safety lock that limits the ability of the articulating portion of the system from articulating. For example, the safety interlock is triggered when the pressure from the gas source is above a certain threshold. Once above this threshold, the articulating portion of the system is locked in place. Once below the threshold the articulating portion of the system is released to articulate again.

In accordance with the various aspects and embodiments discussed herein, the beverage dispensing system includes an engagement device that connects the cartridge that contains the gas source to the plumbing of the system. In one example, the engagement device is one that limits rotation of the cartridge to less than one full turn. Additionally, the engagement device limits cross threading while installing the cartridge into the beverage dispensing system. In one example, the beverage dispensing system receives a bayoneted style connector on the cartridge that engages the system in less than a half turn.

FIG. 1 illustrates an example of a beverage dispensing system 10. Generally, the beverage dispensing system 10 is configured to mix and dispense two or more of a base liquid (e.g., water), flavoring (e.g., a syrup or similar), alcohol, and a gas. In one example, the flavoring and the alcohol are provided to the beverage dispensing system 10 via a pod mechanism 30. Each pod can include a premixed single serving combination of the flavoring and the alcohol.

In one example, the beverage dispensing system 10 includes one or more of a housing 20 having a cover 22, a pod capture and dispensing mechanism 30, a fluid reservoir 40, a chiller and reservoir 50, or a support drain 60. The housing 20 provides the structure from the covers and other elements that support all the mechanisms of the beverage dispensing system 10. The cover 22 shields the internal mechanisms of the beverage dispensing system 10, many of which are discussed herein. The pod capture and dispensing mechanism 30 holds a pod having the flavoring and alcohol for mixing with the fluid. The reservoir 40 holds the fluid for mixing. The chiller and cold water reservoir 50 provides refrigeration and mixing functions for mixing the fluids. The support and drain 60 forms part of the base for catching spilled over liquids.

The various components described in FIG. 1 are merely examples, and other variations, including eliminating components, combining components, and substituting components are all contemplated. For example, the beverage dispensing system 10 can operate without a pod mechanism or the chiller and cold water reservoir, and can instead be plumbed to pre-cooled water or a separate syrup dispensing mechanism.

Figure 2:
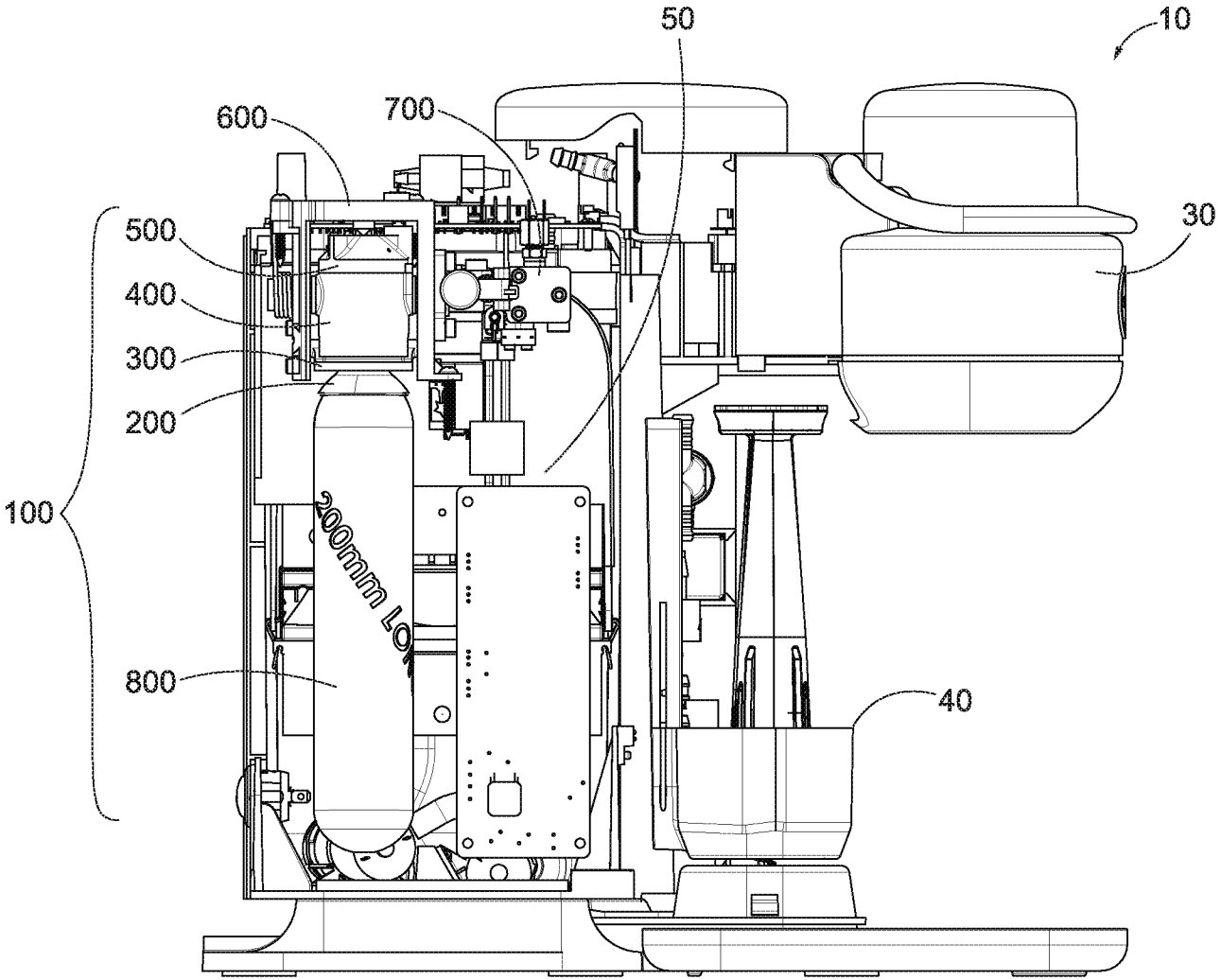
FIG. 2 is a side view (left) of the beverage dispensing machine with the covers removed, showing a gas dispensing system.
Figure 3B:
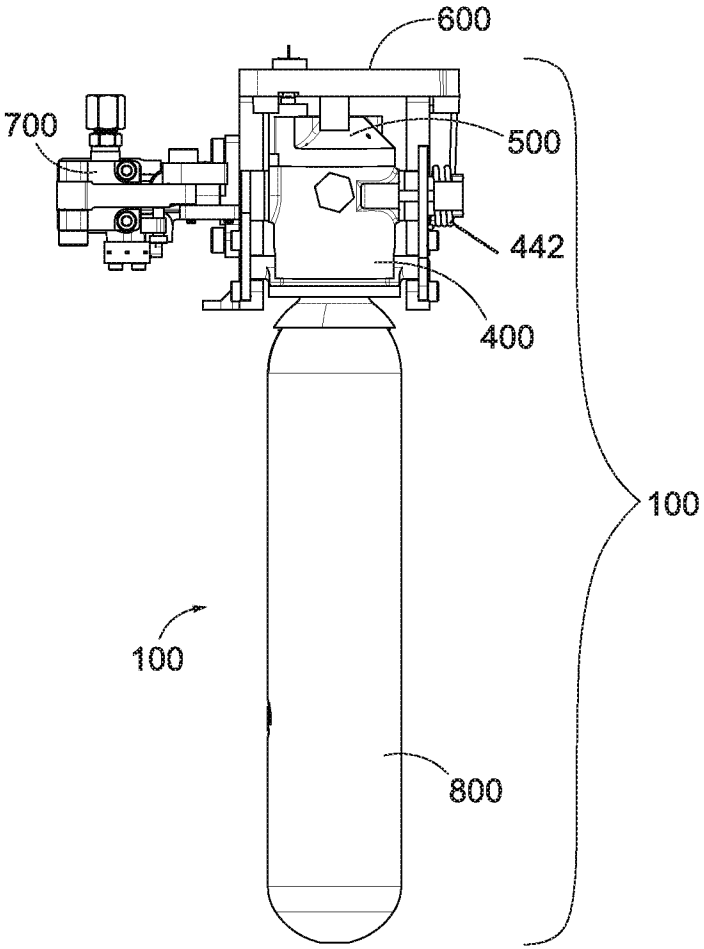
FIG. 3B is a side view (right) of the gas dispensing system.
Figure 3A:
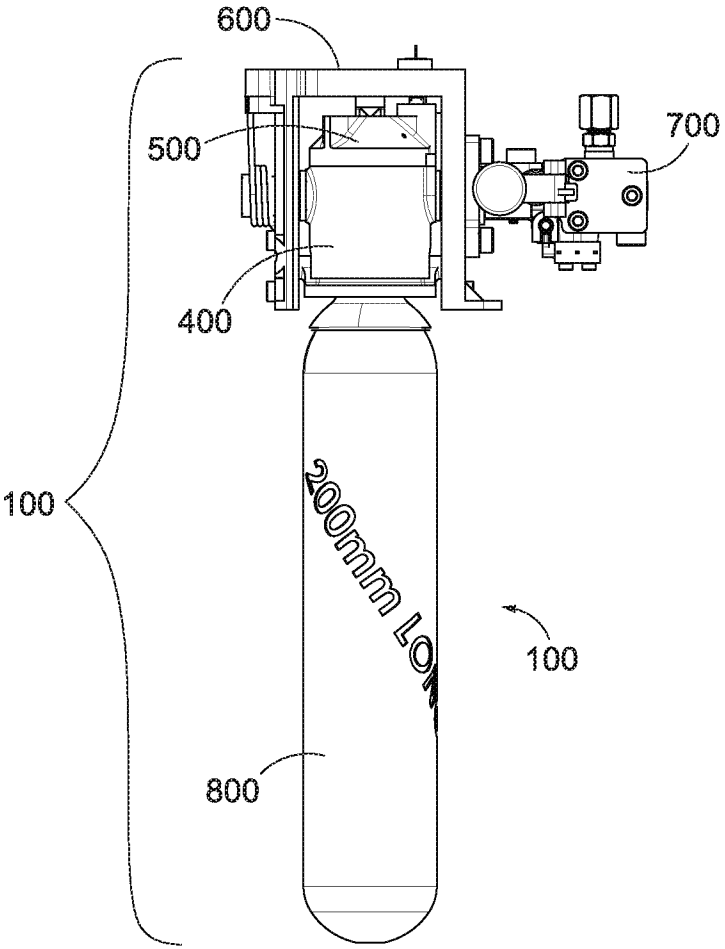
FIG. 3A is a side view (left) of the gas dispensing system.
Figure 3C:
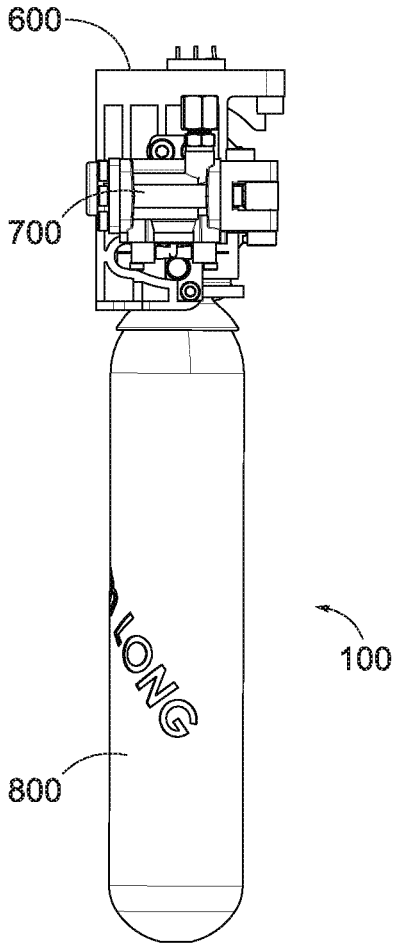
FIG. 3C is a front view of the gas dispensing system.
Figure 3D:
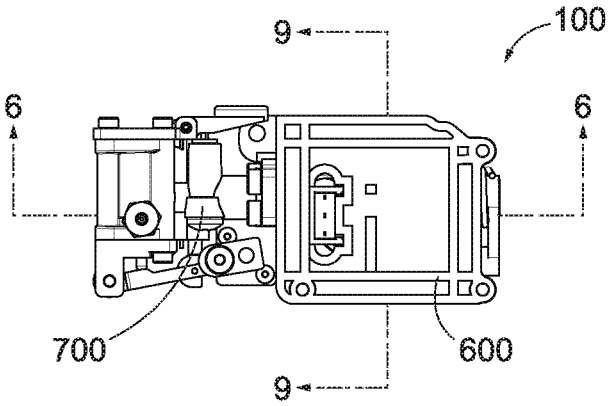
FIG. 3D is a top view of the gas dispensing system.

In accordance with various embodiments, the beverage dispensing system 10 includes a gas dispensing system 100 for infusing or otherwise dissolving the gas in the fluid to form a carbonated fluid. FIG. 2 illustrates an example of the beverage dispensing machine 10 with the covers 22 removed, showing a gas dispensing system 100 from a side view, while FIGS. 3A-3D illustrate an example of the gas dispensing system 100 from various other views. In accordance with various embodiments, the gas dispensing system 100 includes one or more of an intermediary coupler (e.g., receiving coupler 300 or engaging coupler 200), a distribution body 400, a puncture mechanism 500, an articulation mechanism 600, or a valve body 700.

In accordance with various embodiments, the gas dispensing system 100 receives a pressurized gas from a replaceable gas source. For example, the replaceable gas source can be a high pressure gas canister 800. The canister 800 is a sealed pressure vessel that is punctured after installation in the gas dispensing system 100. Once it's depleted, the used up canister 800 can be removed from the system and a new full canister 800 can be installed back into the system.

In accordance with various embodiments, the distribution body 400 is a pressurized gas plumbing system that communicates the pressurized gas between the source gas (e.g., canister 800) and the valve body 700, which in turn directs the gas into the mixing system. The distribution body 400 can include any one or more of various passageways, lumens, or the like, extending between the valve body 700 and the gas source. Additionally or alternatively, other mechanisms can operate in conjunction with, or as a part of, the distribution body 400 like the intermediary coupler, the puncture mechanism, or the interlock mechanism 420 discussed in more detail below. More specific examples of the distribution body 400 are also discussed in detail below.

In accordance with various embodiments, the intermediary coupler (e.g., receiving coupler 300 or engaging coupler 200) connects the pressurized gas source (e.g., canister 800) to the distribution body 400. In various embodiments, the intermediary coupler includes the receiving coupler 300 or the engagement coupler 200. The engagement coupler 200 can be a portion of the gas source (e.g., canister 800) or a component otherwise connected to the gas source (e.g., canister 800). The receiving coupler 300 can be a part of the distribution body 400 or an intermediary component between the engagement coupler 200 and the distribution body 400. In the beverage dispensing industry, different pressurized gasses create a variety of different issues. One concern is safety. In various embodiments, the intermediary coupler establishes a seat between the canister 800 and the rest of the gas dispensing system 100 in less than a full turn. This simple twist and seat verifies insertion of the canister 800. This improves safety by increasing the likelihood of proper engagement before utilizing the beverage dispensing system. Additionally or alternatively, this verified seating between the canister 800 and the gas dispensing system 100 can be completed prior to puncturing of the canister 800 for release of the pressurized gases therein. Again, such an embodiment increases the safety of the system by forming the proper seat before the pressure is released from the canister 800. More specific examples of the intermediate coupler are discussed in detail below. The coupler system can conform and adapt to a variety of different canister types while at the same time preventing the wrong canister from being used in the gas dispensing system 100.

In accordance with various embodiments, the puncture mechanism 500 engages and punctures a new canister 800 to release the pressurized gas from canister 800 after installation. In various examples, the canister 800 includes a seal (e.g., piercing area such as a cap or replaceable plug 810) that is applied to the canister 800 when it filled with the pressurized gas. Once the new canister is fully or partially installed in the gas dispensing system 100, the puncture mechanism 500 punctures, pierces, removes or otherwise breaches the seal, causing the gas dispensing system 100 to pressurize via the pressurized gas source. More specific examples of the puncture mechanism 500 are discussed in detail below.

Figure 4B:
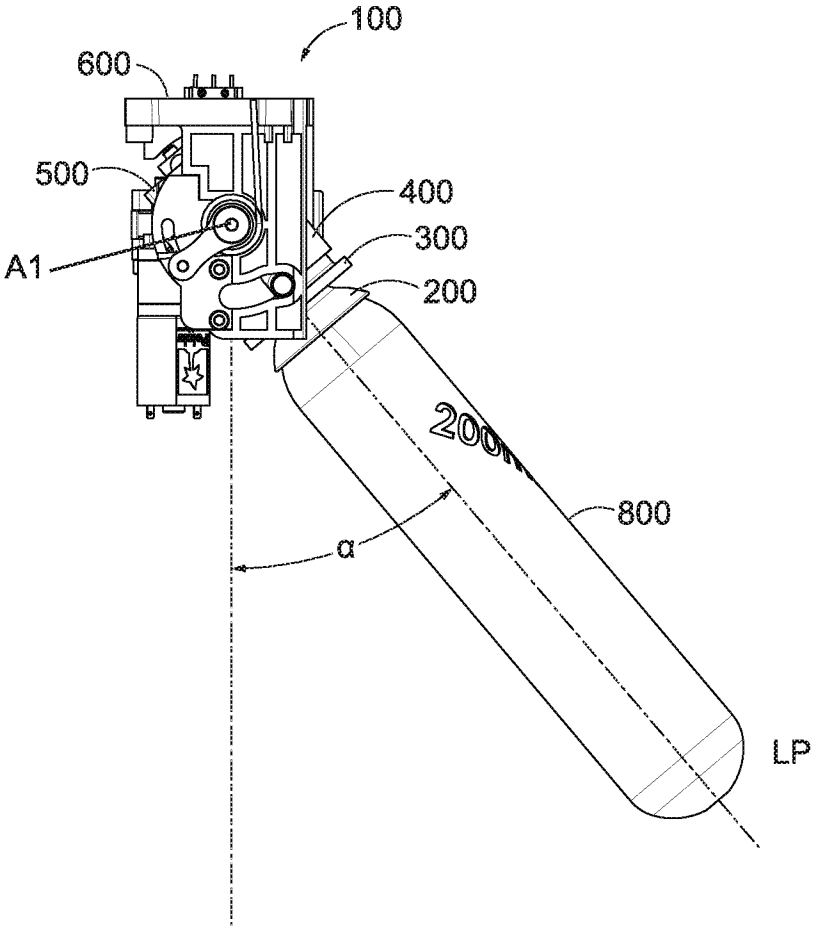
FIG. 4B is a rear view of the gas dispensing system with the canister in a replacement orientation.
Figure 4A:
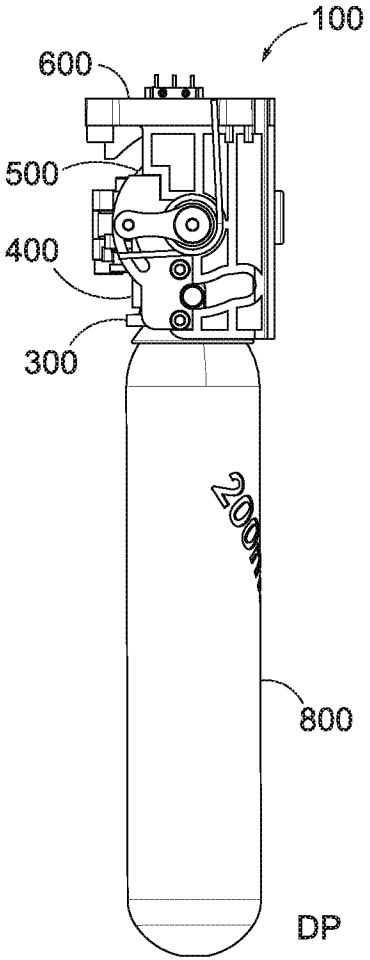
FIG. 4A is a rear view of the gas dispensing system with the canister in a dispensing orientation.

In accordance with various embodiments, the articulation mechanism 600 enables a portion of the gas dispensing system 100 to articulate between various positions. In some embodiments, the portion of the gas dispensing system 100 that articulates allows for pressurizing the system as a whole for subsequent carbonation of liquids. In other embodiments, the portion of the gas dispensing system 100 that articulates allows for the gas source (e.g., canister 800) to be loaded, unloaded, or dispensed. FIGS. 4A-B illustrate an example of articulating a portion of the drink dispensing mechanism 10 from a loading position (LP) (FIG. 4B) to a dispensing position (DP) (FIG. 4A) and back again as necessary. As shown in the particular illustrated example, one or more of the engaging coupler 200, the receiving coupler 300, the distribution body 400, or canister 800 articulate between the LP and the DP. For example, when the canister 800 is extended out into the dispensing position DP, it is easier to grasp and rotate, allowing for simplified removal and loading into and out of the gas dispensing system 100. In one example, as illustrated in FIG. 4B, the articulation mechanism 600 radially translates a lower portion of canister 800 radially outward by rotating an upper portion of the canister. In various embodiments, this articulation allows the canister 800 to rotate approximately 20-65 degrees. In various embodiments, this articulation allows the canister 800 to rotate approximately 35-55 degrees. In various embodiments, this articulation allows the canister 800 to rotate approximately 45 degrees. In other examples, one or more of the engagement coupler 200, the receiving coupler 300, the distribution body 400, or canister 800 can additionally or alternatively translate laterally in their entirety, as opposed to being a merely a combination of rotation and radial translation. More specific examples of the articulation mechanism 600 are discussed in detail below.

In accordance with various embodiments, the valve body 700 controls the flow of pressurized gas into the rest of the beverage dispensing system 10, such as the mixing chamber, which dissolves the gas into the liquid. The valve body 700 can be any traditional valve body suitable to connect to the distribution body 400 and control the flow therefrom. In various examples, the valve body 700 can include one or more electromechanical actuators configured to open and close valves on the various passageways, lumens, or the like, extending from the distribution body 400. In various embodiments, the valve body 700 is controlled by a processor that provides controlled dispensing of the gas for precise mixing of the beverages as requested by the user.

The various components described in FIGS. 2 and 3A-3D are merely examples, and other variations, including eliminating components, combining components, and substituting components are all contemplated. For example, the gas dispensing system 100 can operate without the specific intermediary couplers, and can instead use a direct threaded attachment between the canister 800 and the distribution body 400. In another example, the gas dispensing system 100 can operate without the specific puncture mechanism 500 disclosed herein and instead operate via traditional processes and devices as would be understood by one of ordinary skill in the art.

Figure 5A:
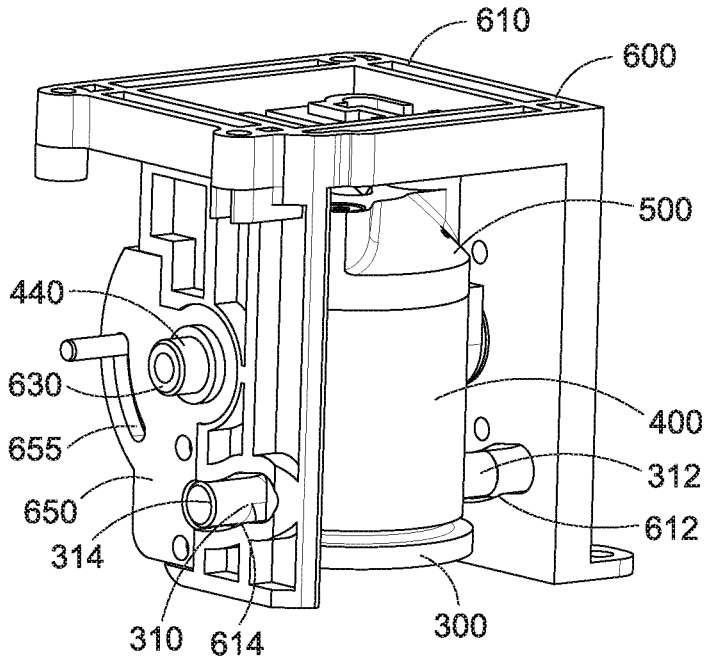
FIG. 5A is an isometric side view (left) of a canister engagement system of the gas dispensing system.
Figure 5B:
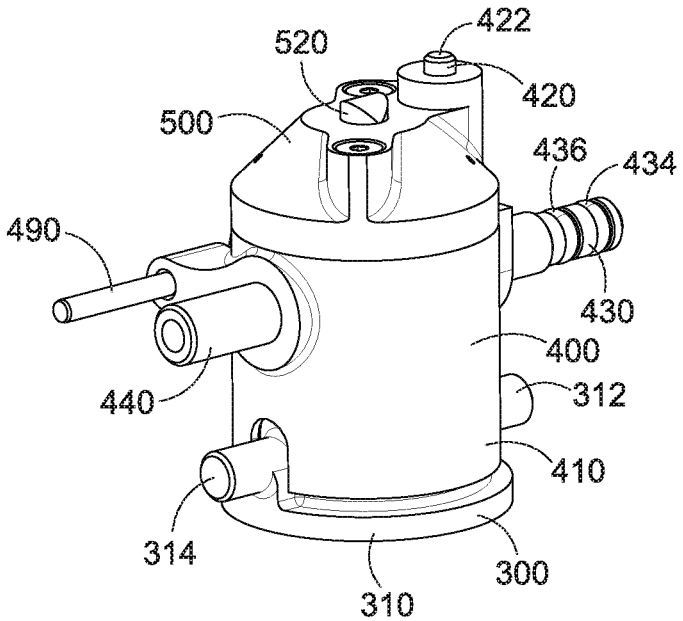
FIG. 5B is an isometric side view (left) of a canister engagement system of the gas dispensing system without the support bracket.
Figure 5C:
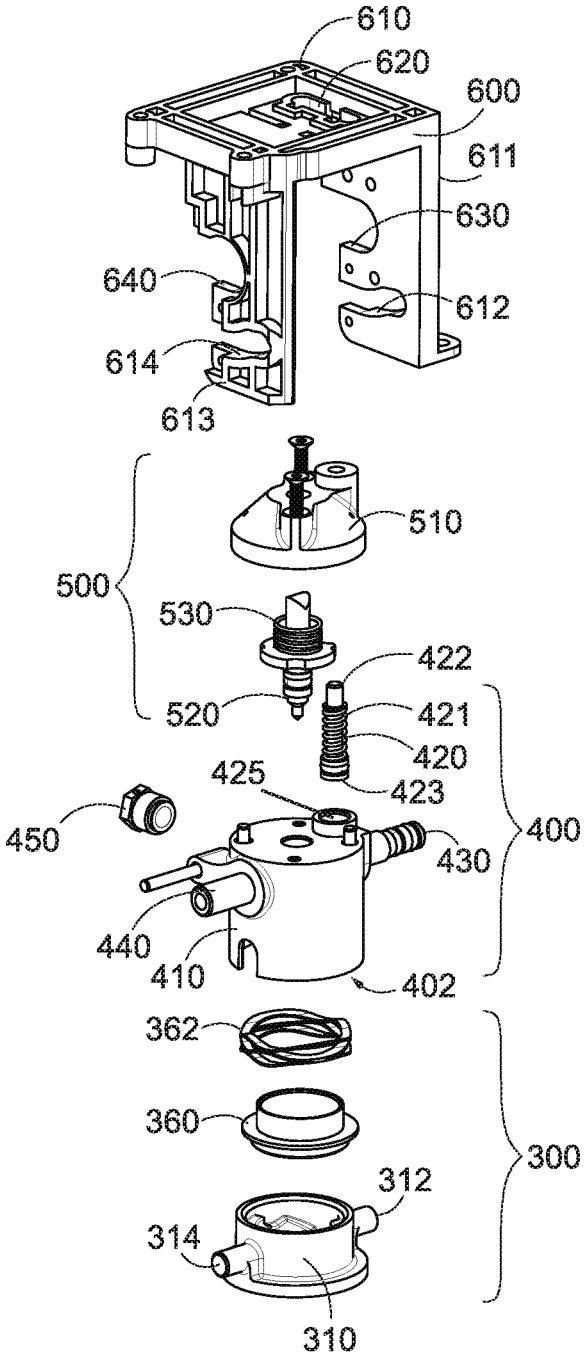
FIG. 5C is an exploded isometric side view (left) of a canister engagement system of the gas dispensing system.
Figure 6:
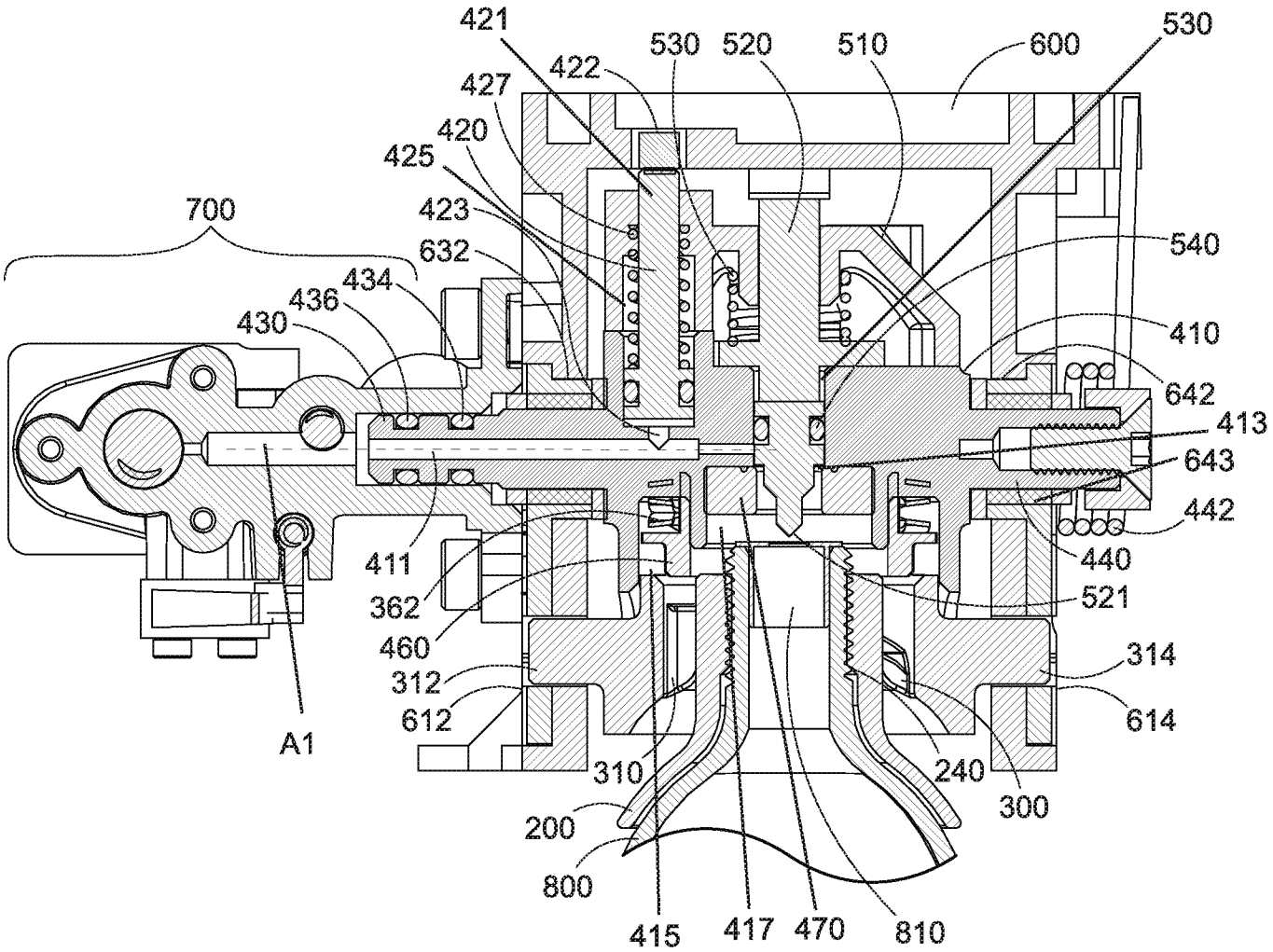
FIG. 6 is a cross section view of the gas dispensing system taken along cross section view line 6-6 of FIG. 3D.

FIGS. 5A and 5C illustrate an example of a canister engagement, articulation and distribution system. FIG. 5B illustrates an example of the distribution system 400 without the articulation system support bracket 610. FIG. 6 illustrates an example of the gas dispensing system 100 taken along cross section view line 6-6 of FIG. 3D. As illustrated by way of example in each of these figures, the various mechanisms (e.g., receiving coupler 300, the distribution body 400, the puncture mechanism 500, and the articulation mechanism 600) can all interoperate as inter-related systems. As discussed above, any one of the systems can operate alone or in combination with any one or more of the other systems.

In accordance with various embodiments, a receiving end 402 of the distribution body 400 can receive the receiving coupler 300. The receiving coupler 300 can include a detent collet 360 or a detent spring 362 to form a preload between the engaging coupler 300 and the receiving end 402 of the distribution body 400.

In various embodiments, a bracket can establish the relationship between the distribution body 400 and the receiving coupler 300. In one example, support bracket 610 sets the relationship between the distribution body 400 and the receiving coupler 300. In a more particular example, support bracket 610 can have side walls 611 and 613 with apertures 612 and 614 that receive and support the body 310 of the engaging coupler 300. In one example, support elements 312 and 314 extend from the body 310. Apertures 612 and 614 receive the support elements 312 and 314, respectively. The support elements 312 and 314 can be protrusions extending from the body 310, such as circular protrusions. In various embodiments, apertures 612 and 614 define cam paths that guide the support elements 312 and 314, which act as followers along the cam path.

As discussed in more detail below, the articulation mechanism 600 can also support portions of the distribution body 400, allowing it to rotate. For example, protrusions 430 and 440 can rotate within grooves 640/630. By supporting both the distribution body 400 and the receiving coupler 300, the bracket can dictate or establish respective articulation between the two elements. In particular, receiving coupler 300 follows the cam path 614/612, which, as shown in FIG. 4B, does not necessarily maintain a constant radius arc with respect to the rotation of the distribution body around its axis A1. Thus, as the articulating portion of the gas distribution system 100 rotates from LP to DP the cam path decreases its distance from A1, causing the receiving coupler 300 to slide into the interior chamber 415 of the body 410 of distribution body 400. The distribution system 100 can also include a second chamber 417 configured to receive a seal 470. As the receiving coupler 300 is slid into the interior chamber 415, the canister end 811 is engaged against the seal 470 forming a pressure tight seal. The seal allows the pressure from the canister 800 to be received into the lumens without leaking outside of the pressurized path.

In accordance with various embodiments, there can be direct engagement between the receiving coupler 300 and the distribution body 400 to form a seal and keep the system pressurized. In other embodiments, however, a collet forms an intermediary guide or seal between the receiving coupler 300 and the distribution body 400. In particular, the collet can aid in aligning the engagement coupler 200, the receiving coupler 300 and the distribution body 400. In various examples utilizing a collet, the collet can also be spring loaded such that a force is consistently applied against the engagement coupler 200, the receiving coupler 300, and the distribution body 400. In one example, the collet 460 is a compression spring or wave spring that is positioned concentrically between the distribution body 400 and a flange extending from the collet 460, such that the collet exerts a force against the engagement coupler 200 or the receiving coupler 300, thereby maintaining a preload on the engagement system as the canister 800 is rotated from LP to DP. As shown in FIG. 6 the collet 460 and the spring 362 provide a positive lock by pressuring the couplers 200 and 300 together and biasing them from the distribution body 400 in an over center manner.

The various components described in FIGS. 5A-C and 6 are merely examples, and other variations, including eliminating components, combining components, and substituting components are all contemplated. While some systems are discussed as being grouped together while other systems are discussed herein as being discreet systems, it should be noted that single devices can form parts of separate systems. In embodiments, having both systems, the single device would have the attributes of both systems, but in embodiments absent one system or the other, the single device is still present for the system forming a part of the embodiment, but the attributes forming the part of the absent system can be absent from the device. For example, support bracket 610 can include parts of the articulation mechanism 600 and the safety interlock mechanism 420. However, as a person of ordinary skill in the art would recognize based on this disclosure, in embodiments of the gas distribution system 100 lacking one of those two systems, such as the safety interlock system 420, then the support bracket 610 similarly can lack the attributes of the safety interlock system 420.

As discussed above, the distribution body 400 provides a plumbing system for the pressurized gas from the gas source (e.g., canister 800) to the valve body 700. Additionally or alternatively, the distribution body 400 can provide elements for one or more of the articulation mechanism 600, the interlock system 420, or canister puncture mechanism 500, as such systems are variously included depending on the embodiment. In accordance with one embodiment, distribution body 400 includes a body 410 that defines various passages or lumens. For example, the body 410 can define a receiving lumen 413. The receiving lumen 413 is proximate to the entry of gas and gas pressure from the gas pressure source (e.g., canister 800). Distribution body 400 can also include a distribution lumen 411. The receiving lumen 413 is proximate to the exit of gas and gas pressure into the valve body 700. One or more lumens can be optionally sealed by a removable cap 450.

Figure 9B:
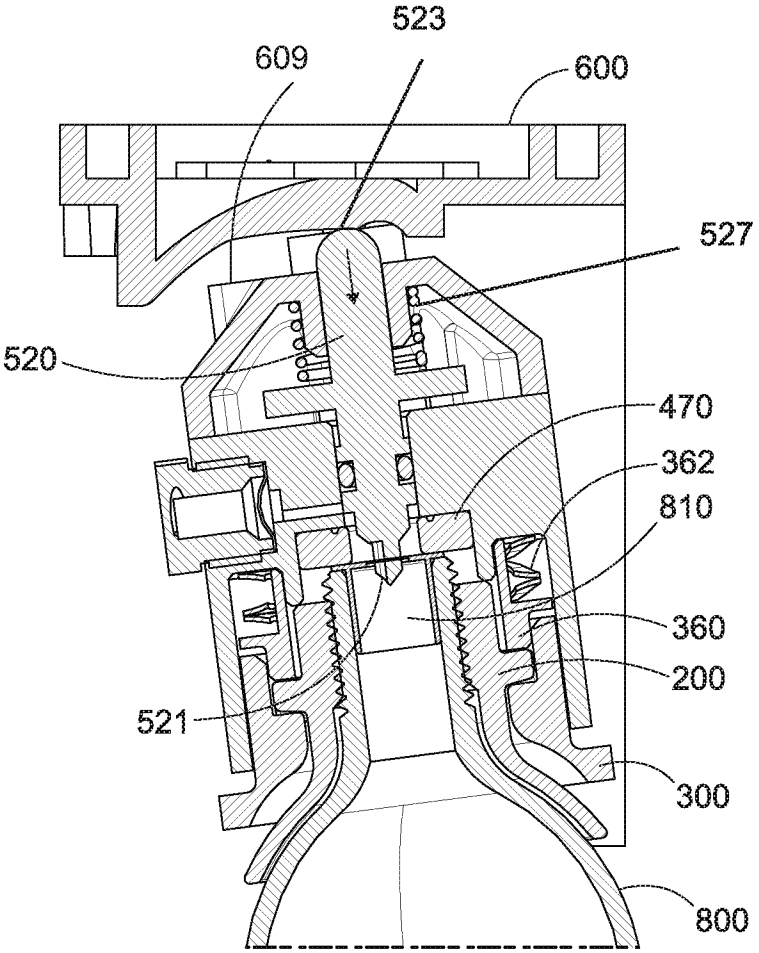
FIG. 9B is a cross section view of the gas dispensing system taken along cross section view line 9-9 of FIG. 3D in a puncturing orientation.
Figure 9A:
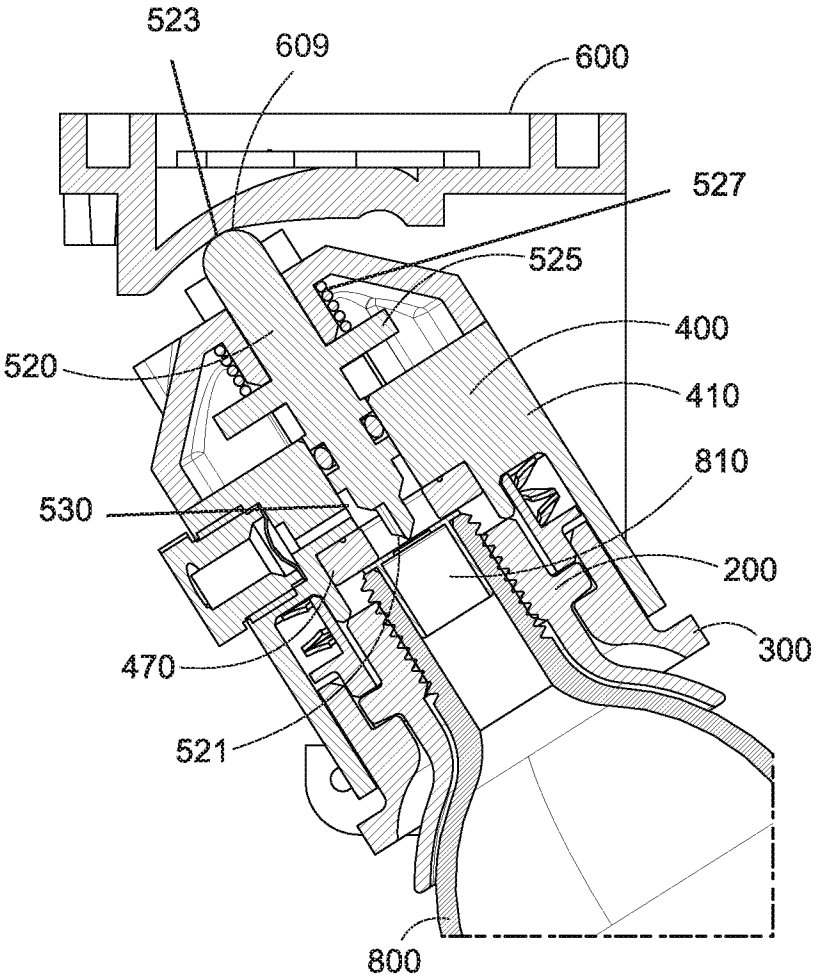
FIG. 9A is a cross section view of the gas dispensing system taken along cross section view line 9-9 of FIG. 3D in a replacement orientation.

As is illustrated in FIG. 6, the distribution body 400 also includes articulation features that allow the gas source to articulate between the LP and the DP (see FIGS. 9A and 9B). For example, the body 410 can include protrusions 430 and 440. Protrusions 430 and 440 extend from opposing sides of the body 410 and engage the support bracket (e.g., grooves 640/630) on the bracket body 610, or in other embodiments, supplemental bracket body 650 (as shown in FIG. 5A). In the particular example shown in FIGS. 5A-B and 6, bracket body 650 includes apertures 632 and 642 on opposing sides of the bracket 650. The apertures 632 and 642 in turn receive a friction-reducing element 643 (e.g., bearing, bushing or similar) or direct engagement with the protrusions 430 and 440. The protrusions 430 and 440 are then able to rotate within the apertures 632 and 642, allowing the distribution body 400 to rotate along with each of the features forming a part thereof as they are utilized in the various embodiments. The rotation occurs around axis A1. In some embodiments, axis A1 also defines the path of the distribution lumen 411. As such, in those embodiments, the distribution lumen does not translate in location via the articulation, but instead merely rotates about its own longitudinal axis A1. In embodiments, where lumen 411 is concentric with axis A1, some translational articulation would occur. In some embodiments, the bracket body 610 and supplemental bracket body 650 are a single contiguous piece. In other embodiments, the bracket body 610 and supplemental bracket body 650 are multiple different elements.

In some embodiments, the body 410 can include a secondary protrusion 490 extending parallel to the protrusions 430 and 440. The secondary protrusion 490 can engage a cam path 655 on the bracket (e.g., bracket 610 or 650). This secondary engagement between the distribution body 400 and the bracket body 610/650 can provide greater alignment. Alternatively or additionally, it can also allow for a biasing force to be applied between distribution body 400 and the bracket body 610/650. For example, one end of a torsion spring 442 can anchor on the bracket 610 and one end of the secondary protrusion 490, with the center wrapped around axis A1. Such an arrangement can bias the articulating system into either the LP or the DP.

The exterior of protrusion 430 can be received in the valve body 700. In such an embodiment, the exterior surface of protrusion 430 can have channels and seals 436 or 434 to maintain a pressure seal between the distribution body 400 and the valve body 700.

In accordance with various embodiments, the safety interlock system 420 is a pressure interlock that interacts with the distribution body 400. The interlock 420 can operate so that in response to a pressure at or above a pressure threshold, the interlock 420 limits or prevents articulation of the articulating portions of the gas dispensing system 100. Furthermore, the interlock 420 can operate so that in response to a pressure below the pressure threshold the interlock 420 allows articulation of the articulating portions of the gas dispensing system 100.

In one example, the interlock 420 includes an interlock lumen 425. The interlock lumen 425 extends from the receiving or the dispensing lumen (e.g., lumens 411 or 413). At or above the pressure threshold, the interlock lumen can engage the dispensing body 400 and the support bracket (e.g. bracket 610 or 650) limiting or preventing relative motion of the two. The interlock 420 can include a pin 421 that occupies the interlock lumen 425. An increase in pressure in the dispensing body 400 lumens causes the pin 421 to translate within the interlock lumen 425. The pin 421 can be integrated with the distribution body 400 using a seal 423, which can help prevent gas leakage at the interlock lumen 425, in certain embodiments.

A portion 422 of the pin 421 can extend out of the body 410 (including at least partially out of a cap 510) in response to being at or above the pressure threshold, such that the pin 421 engages with the bracket (e.g. bracket 610 or 650) and the interlock lumen 425 in the body 410, at the same time limiting or preventing articulation of the body 410 relative to the bracket (e.g. bracket 610 or 650). In some embodiments, and as shown in FIG. 5C, the bracket (e.g. bracket 610) can include a receiving slot 620, which receives the external portion 422 of the pin 421. The slot 620 can be of sufficient length to allow moderate movement of the articulating portions (e.g. 10-20 degrees) of the gas dispensing system 100 without decreasing safety (i.e. allowing the user to fully remove the canister while pressurized). In other embodiments, the slot 620 fits the pin 421 allowing for negligible movement. In other embodiments, the slot can be of sufficient size and length for locating a switch that provides an electric signal to the control system in response to the presence of the external portion 422 of the pin 421, thereby indicating the system is pressurized.

In accordance with various embodiments, the interlock can also include the biasing member 427 that biases the pin 421 toward the interlock lumen 425. The force provided by the biasing member 427 can establish the interlock threshold. For example, once the pressure reaches the threshold, the biasing force of the biasing member 427 toward the interlock lumen 425 is overcome by the outward force from the pressure. When the biasing member force is overcome by the outward force due to the pressure, the pin 421 slides outwardly and locks with bracket (e.g. bracket 610 or 650). In various examples, the biasing member 427 is a spring.

FIGS. 7A-7D and 8A-8D illustrate an example of a carbonation connection device. FIGS. 7A-7D are directed to an example of a canister engagement coupler. As discussed above, in various embodiments, the engagement coupler can be formed as a part of the canister 800. For example, the canister can be formed without a threaded engagement but instead have tabs extending radially from the dispensing end. In other examples, the engagement coupler 200 is a separate discrete component that is removable and attachable to the canister 800. In accordance with various embodiments, an engagement coupler 200 can include a wall 210. The wall 210 defines an internal surface 216. The internal surface 216 defines an opening 212 from a receiving end 217 of the engagement coupler 200 to a dispensing end 214 of the coupler 200. The opening 212 is suitable to receive a dispensing end of a carbonation canister 800.

The engagement coupler 200 includes lateral supports 220/230. The lateral supports 220/230 can extend in a plurality of directions from the exterior surface 211 of the wall 210. While discussed herein and shown in the figures by way of example, the engagement coupler 200 as a separate attachment to a canister 800, the elements of the engagement coupler 200 can form a contiguous portion of the canister 800. For example, generally the wall 210 can be annular with a bell-shaped end 218. The canister 800 can define the annular wall and bell shaped portion 218 or a separate element can define these parts and then be attached (e.g. threaded onto canister 800). The support 220/230 supports the weight of the carbonation canister 800. In one example, the support tabs 220/230 can be U-shaped. For example, the support can have a base 231 with tapered surfaces 232 and 233 extending from either side of the base. The tapered surfaces 232 and 233 can be tapered toward the dispensing end 214. The support tabs have the open end of the U-shape that can similarly extend toward the dispensing end of the engagement coupler. In various examples, the support tabs extend from opposing radial sides of the wall 210. After attaching the engagement coupler 200 to the canister 800, the supports 220/230 engage the receiving coupler 300. In this way, the engagement coupler 200 suspends the carbonation canister 800 from the receiving coupler 300.

Figure 7A:
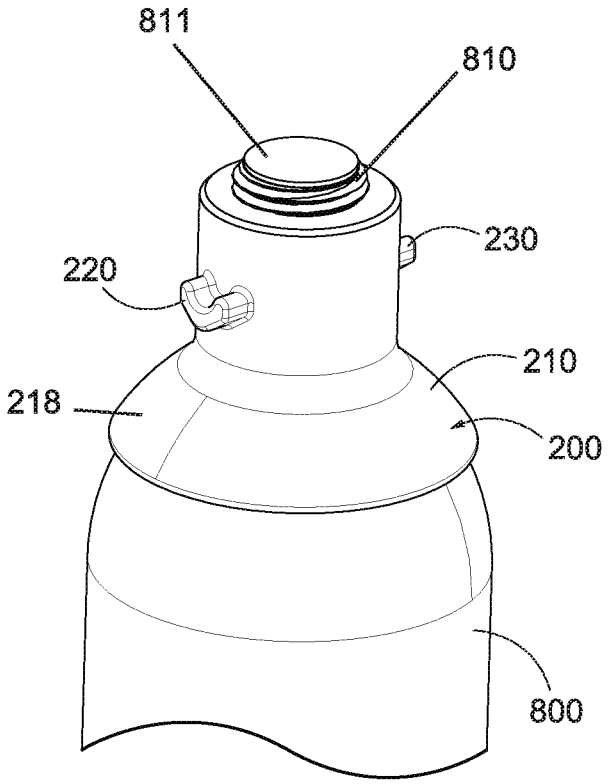
FIG. 7A is an isometric side view of a canister engagement coupler on the canister.
Figure 7B:
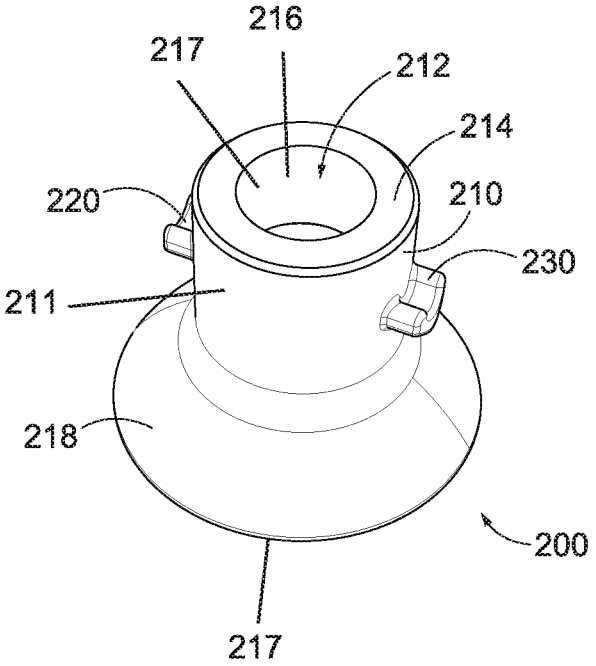
FIG. 7B is an isometric side view of the canister engagement coupler.
Figure 7C:
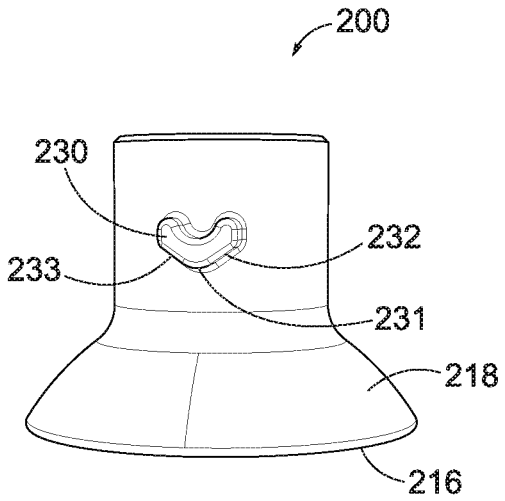
FIG. 7C is a side view of the canister engagement coupler.
Figure 7D:
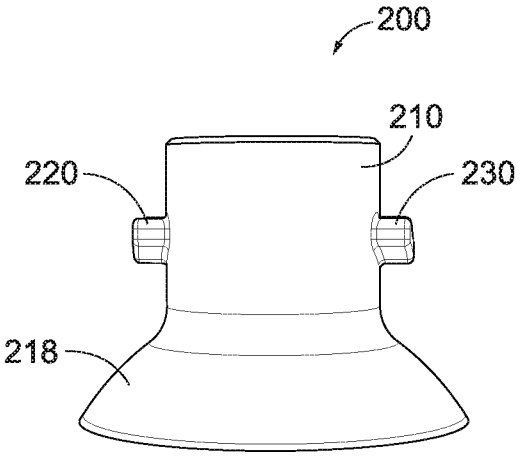
FIG. 7D is a different side view of the canister engagement coupler.
Figure 8A:
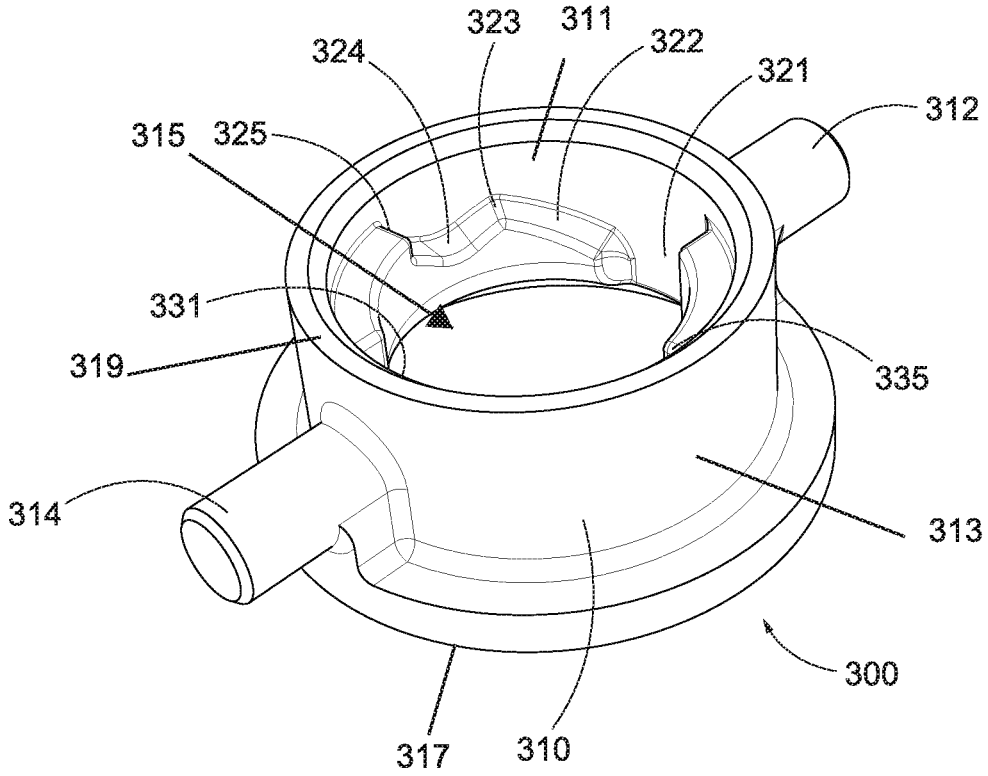
FIG. 8A is an isometric side view of a canister receiving coupler.
Figure 8B:
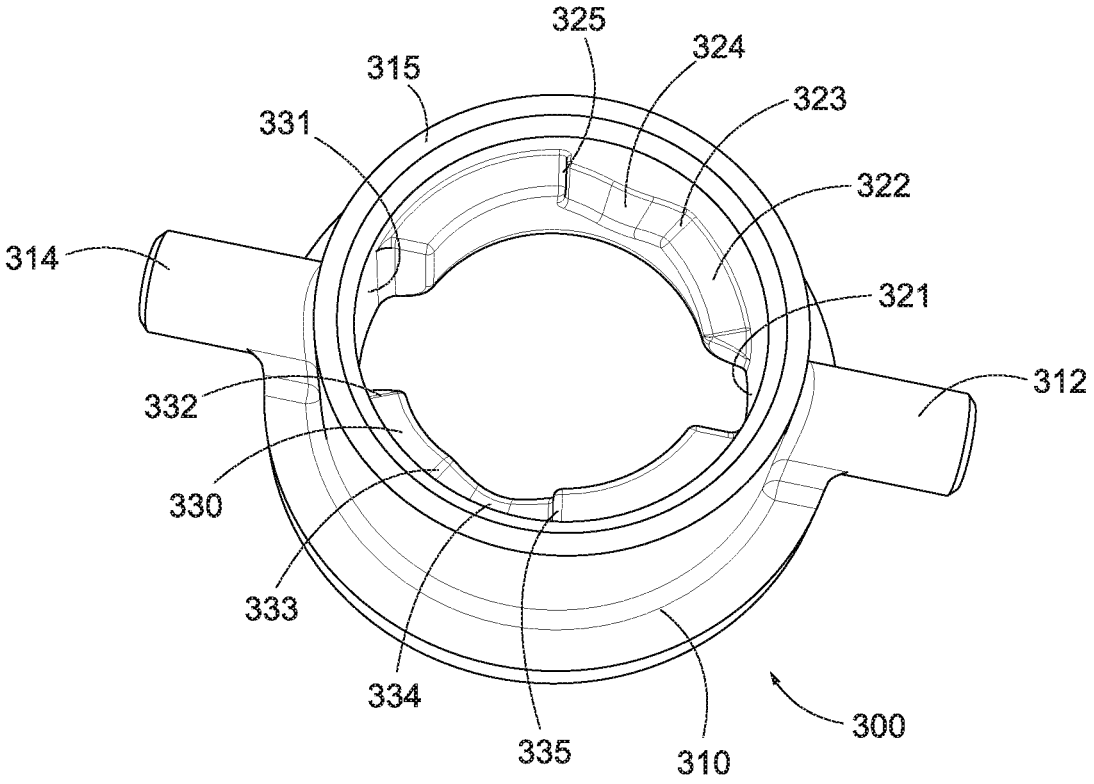
FIG. 8B is an isometric top view of the canister receiving coupler.
Figure 8C:
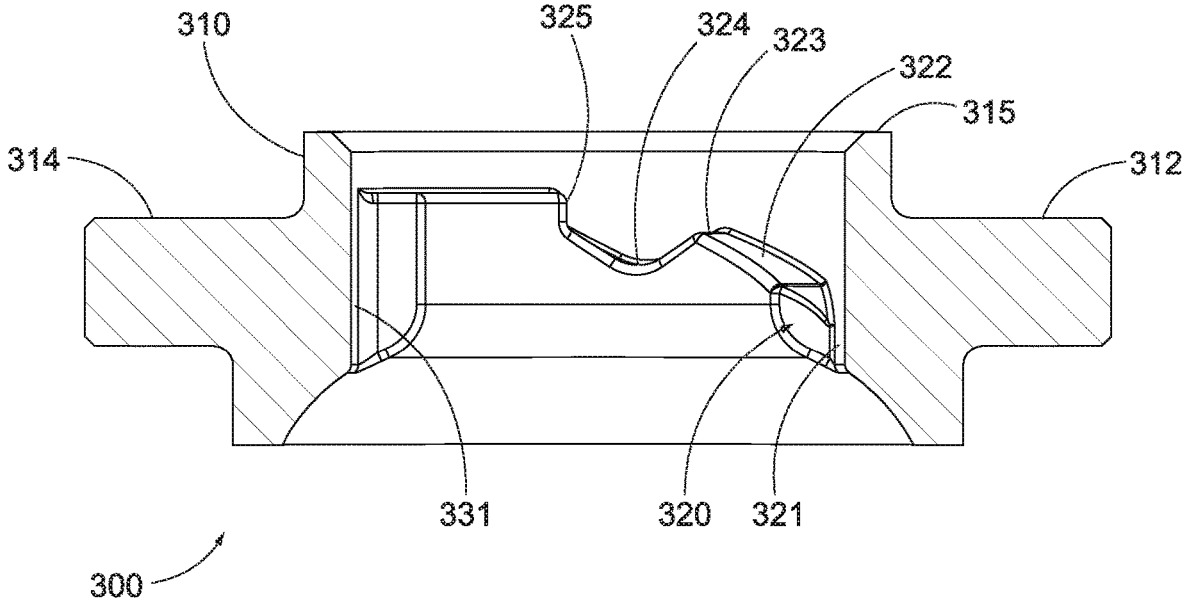
FIG. 8C is a side view of the canister receiving coupler.
Figure 8D:
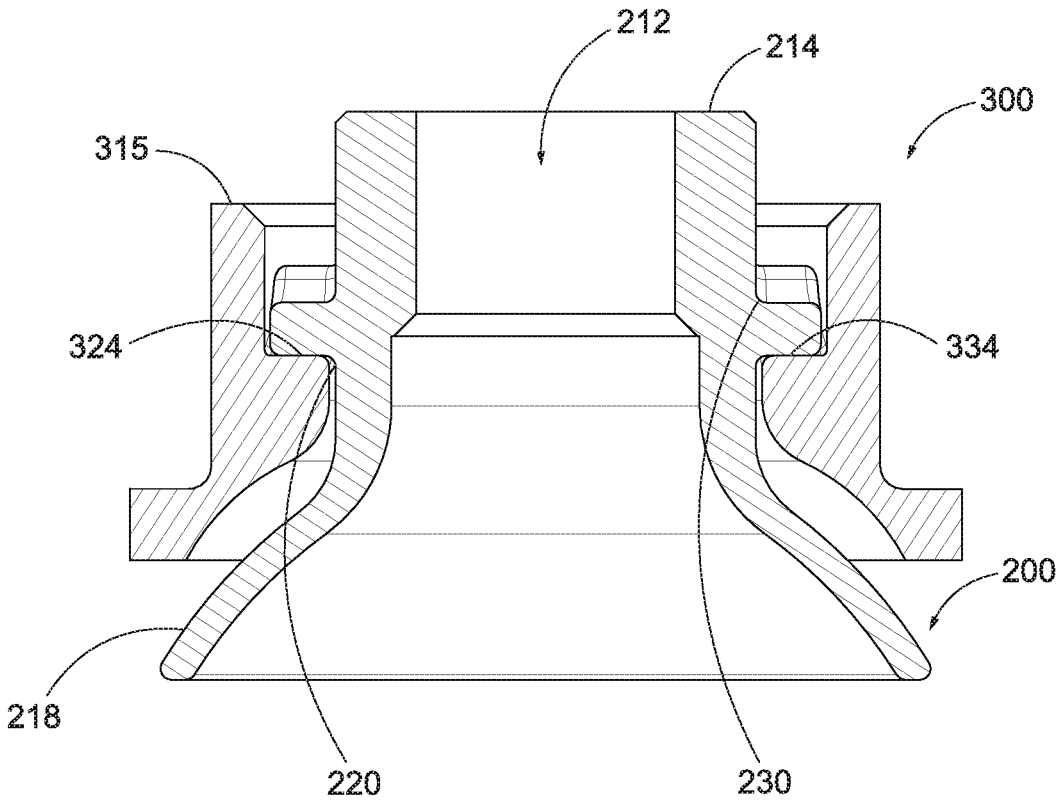
FIG. 8D is a cross sectional side view of the canister receiving device coupled with the canister engagement device.

An engagement coupler 200 can include an internal engagement mechanism 240 for coupling the internal surface 216 of the wall 210 to the carbonation canister 800. In one example, the internal engagement mechanism 240 can include an interior threaded surface that corresponds to external threads on the neck of canister 800. The receiving end 217 is bell-shaped 218 to extend around a profile of a carbonation canister 800 as shown in FIG. 7B. In this way, the bell-shaped end 218 can slip over the canister 800 and then the engagement mechanism 240 (e.g., threads) can be used to engage the canister 800.

FIGS. 8A-8D are directed to an example of a canister-receiving coupler 300. In accordance with various embodiments, the receiving coupler 300 includes a body 310. The body 310 includes an internal surface 311 and external surface 313 that define an opening 315 from a receiving end 317 of coupler to a mating end 319. The opening 315 is sized to receive a dispensing end 811 of the carbonation canister 800 or in embodiments having a discrete engagement mechanism, the opening 315 is sized to receive the engagement coupler 200.

The receiving coupler 300 can also include a shelf 320 formed on the internal surface 311 of the wall. The shelf 320 supports the engagement supports (e.g., 220, 230). The shelf 320 can do this regardless of whether the supports extend from a carbonation canister 800 directly or from the engagement coupler 200. The shelf 320 is sized and strong enough for the carbonation canister 800 to be suspended from the shelf 320. The receiving coupler 300 can also include a clearance portion 321 forming part of the internal surface 311 of the wall body. The clearance portion 321 is defined as a larger radial distance at the opening 315 and extending past the shelf 320. The radial distance of the clearance portion 321 is sufficiently large to allow the carbonation canister 800 and the engagement support 220 to pass into an opening above the shelf 320. In this relationship, the engagement coupler 200 or the canister 800 can be turned to set the support 220 on the shelf 320. In accordance with various embodiments, the shelf 320 extends from the clearance portion 321 in such a way as to allow the engagement support 220 to rest on the shelf 320 in response to rotating the carbonation canister 800.

In various examples, the receiving coupler 300 includes a plurality of shelves 320 and 330 and clearance portions 321 and 331 formed on the internal surface 311. The plurality of clearance portions 321 and 331 correspond to placement of the engagement supports 220 and 230 such that there is sufficient clearance to receive the engagement coupler 200 past the shelves. The plurality of shelves 320 and 330 corresponds to placement of the engagement supports 220 and 230.

The shelves 320/330 can extend in multiple sections. For example, the shelves 320/330 include ramp sections 322/332. The ramp section 322/332 start proximal to the clearance sections 321/331 and extend from the receiving end 317 toward the mating end 319 along a portion of the circumference of the internal surface 311. In an additional or alternative example, the shelves 320/330 can include portions that form troughs 324/334. The troughs 324/334 form detents or low spots on the shelves so that the engagement supports 220/230 are biased to the low portions and consequently form a detent to aid in holding the carbonation canister 800 position. The detent portion and the stop provide a tactile feel for a user to gauge when the dispensing position is reached. In an additional or alternative example, the shelves 320/330 can include portions that form transitions 323/333 between the ramp portion 322/332 and the troughs 324/334. In an additional or alternative example, the shelves 320/330 can include portions that form stops 325/335 that limit additional rotation of the canisters 800 or the engagement couplers 200 in the receiving coupler 300. For example, the stops are positioned proximal to the troughs 324/334, such that the stops prevent continued rotation past the troughs 324/334.

The receiving coupler 300 can also include external supports of suitable strength to support the carbonation canister in a beverage dispensing system. The external supports are protrusions that extend from opposing sides of the wall, with the protrusions suitable to function as followers for engaging in a cam path.

As disclosed herein as an example of a discrete component in an assembly, the receiving coupler 300 can alternatively be formed as a part of the distribution body 400. However in examples with the receiving coupler 300 as a separate discrete component, the receiving coupler 300 can also be movable relative to the distribution body 400. The engagement coupler 200 and receiving coupler 300 connect the canister 800 to the distribution body 400. In various embodiments, as shown in FIG. 6, the receiving coupler 300 is received into a first end of the distribution body 400. At least a portion of the engagement coupler 200, receiving coupler 300, and the distribution body 400 articulates via a pivoting joint such that a canister 800 attached thereto is able to swing due to the pivot. Additionally or alternatively, a portion of the connector (e.g., receiving coupler 300) can move longitudinally into and out of the distribution body 400 as the receiving coupler 300 articulates. The receiving coupler 300 and the distribution body 400 can be both supported by the articulation mechanism 600 bracket. The distribution body 400 can be pivotably supported by the bracket via the pivoting joint and the receiving coupler 300 can be supported by the cam path 612 and 614 on the articulation mechanism 600 bracket (e.g., bracket 610) thereby allowing the relative movement between the distribution body 400 and the receiving coupler 300. In this way the coupler 300 can drive the canister 800 toward the distribution body 400. In additional or alternative embodiments, discussed in more detail below, the coupler 300 can drive the canister 800 toward the seal 470 while the release element 420 drives the canister 800 away from seal 470 all during the articulation of the device.

In accordance with various embodiments, the gas distribution system 100 can include a canister pressure release mechanism 500 suitable to pierce and release the pressurized contents from the gas source (e.g., canister 800). FIGS. 9A-9B illustrates an example of the release mechanism 500. In accordance with one embodiments, the release mechanism 500 releases the pressurized gas as the gas source (e.g., canister 800) articulates from between different positons (e.g., DP and LP as discussed above in the context of other systems). In one example the gas source rotates between the different positions. The rotation of one or more of canister 800, coupler 200/300, or distribution body 400 engages the release mechanism 500 such that gas is release from the canister 800.

In various examples, the distribution body 400 includes a channel or lumen 530 that extends to the gas source (e.g., canister 800). As discussed above the canister 800 can include piercing area 810 (e.g., a cap or replaceable plug as shown) located proximal to the deposing end 811. In accordance with one example, the channel 530 extends to the piercing area. A puncture element 520 is movably received in the channel 530 such that in response to articulation of the gas source, the puncture element 520 moves towards and punctures the piercing area 810 of the canister 800. In some cases, the puncture element 520 may be seated at least partially within a cap 510. The cap 510 can defining an interface between the distribution body 400 and the articulation mechanism 600. The puncture element 520 can be seated within the cap 510 and partially sealed by a sealing ring 540.

In a particular example, the distribution body 400 can be defined in accordance with other embodiments discussed herein. Additionally or alternatively, the channel or lumen 530 can intersect with lumen 411 or 413 as shown, for example, in FIG. 6. The release mechanism includes the puncture element 520. The puncture element can be a pin, shaft, anvil, or other element suitable for puncturing piercing or otherwise releasing the pressurized gas from the gas source. In one example, the puncture element 520 includes a sharpened tip 521 that reduces the force necessary for the puncture element 520 to pierce the piercing area 810. In some embodiments the tip 521 also include a path for communicating pressurized gas to the receiving lumen 413. While not intended to be limiting of the actual mechanism, for the sake of simplicity, the puncture element 520 will be referred to herein as a pin 520 by way of example. In various examples, the pin 520 moves longitudinally in the channel 530. By moving toward the piercing area 810, the pin 520 or pierces the canister to release the pressurized gas. Because the pin is located in the channel 530 and, in various embodiments, the channel 530 intersects with and is in fluid communication with at least one of the receiving lumen 413 and the distribution lumen 411, in response to piercing the canister 800, the receiving lumen 413 and the distribution lumen 411 are pressurized via the gas source in canister 800.

As indicated above, the canister 800 can be pierced in response to its articulation. In such embodiments, as the canister 800 articulates, the pin 520 translates along the piercing channel 530 until it engages with the canister 800. Any suitable mechanisms can be used to drive the pin 520 into the canister 800 in response in any suitable form of articulation. In accordance with one example, the pin 520 includes a follower end 523. The follower end 523 can be positioned opposite the piercing end 521. The follower end 523 is suitable to follow a cam path 609. In one example, the bracket 610 includes a cam path 609 and the pin 520 extends out of the distribution body 400 and contacts the cam path 609. By following the cam path 609 via contact between the cam path 609 and follower end 523, the cam path can control the position of the 520. For example, as the canister 800 articulates, the follower 523 can follow the cam path 609 and the cam path 609 can drive the follower towards the piercing area 810 as the canister's articulation approaches the dispensing position DP shown in FIGS. 4A and 9C.

Figure 9C:
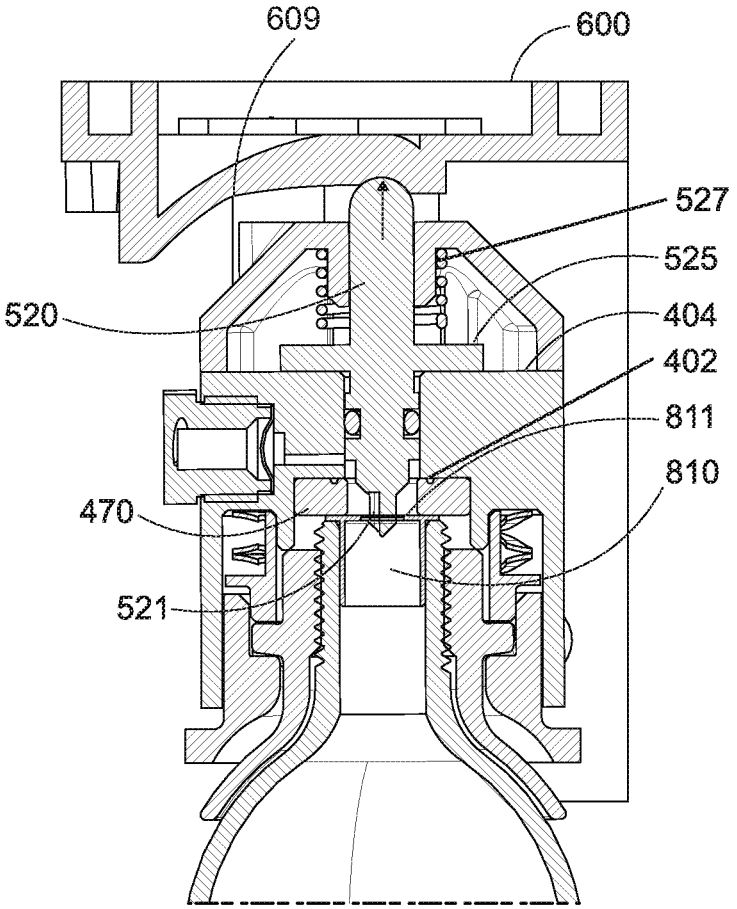
FIG. 9C is a cross section view of the gas dispensing system taken along cross section view line 9-9 of FIG. 3D in a dispensing orientation.
Figure 9D:
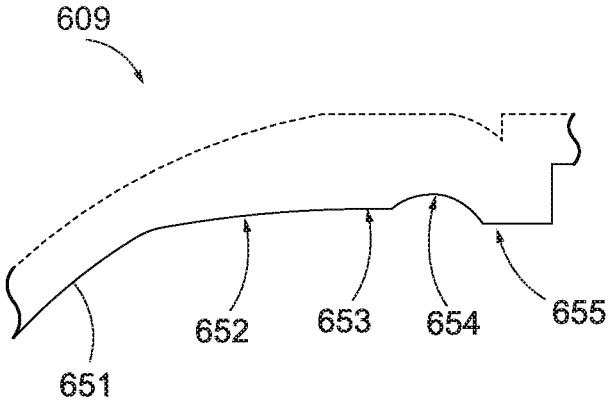
FIG. 9D is an illustrative cam path of the gas dispensing system.

In accordance with various embodiments, the cam path 609 can include a profile suitable for safe and efficient insertion of the pin 520 into the piercing area 810. A sample profile of the cam path 609 is shown in FIG. 9D. For example, the cam path 609 can include an entry portion 651 that correlates with the position of the pin follower 523 when the canister 800 is rotated outward into a loading position LP as shown in FIG. 9A. The entry portion 651 of the cam path 609 is located at a sufficient distance from the piercing area 810 of the canister 800 so that the pin 520 has space to be positioned outside of the canister 800 (i.e. between the piercing area 810 and the entry portion 651) without piercing the piercing area 810. The cam path can also include a progressive portion 652 that correlates with the position of the pin follower 525 when the canister 800 is articulating between the loading position LP and a dispensing position DP. This progressive portion 652 of the cam path 609 can include a range of distances between the piercing area 810 and the cam path 609 such that the pin 520 begins to approach or engage the canister 800 as the canister 800 and pin 520 travel through the articulation range. The cam path can include a max pressure portion 653 that correlates with the position of the pin follower 523 when the canister 800 is substantially all the way to dispensing position and the pin 520 extends the farthest into the canister 800 forming the puncture. The max pressure portion 653 is the smallest distance between the cam path 609 and the piercing area 810. In some embodiments, the cam path 609 can include a detent portion 654 that correlates with the dispensing position DP. The detent portion 654 of the cam path 609 is farther from piercing area 810 than the max portion 653. In some embodiments, the cam path 609 can include a stop portion 655 that prevents or limits ration of the canister 800 or pin 520 beyond the detent portion 654. The stop portion 655 can be defined by a sharp decrease in the distance between the cam surface 650 and the piercing area. In this manner the pin 520 is limited in its ability to follow the cam path 609 into the stop portion 655. The detent portion and the stop provide a tactile feel for a user to gauge when the dispensing position is reached.

In accordance with various embodiments, the pin 520 can include a flange 525 suitable to restrain the travel of the pin 520 or provide a support surface for a biasing mechanism 527. The flange 525 can extend radially from the pin 520 such that it can contact the distribution body 400 on the end 404 thereof as shown for example in FIG. 9C. The biasing mechanisms can be a spring or other suitable device that biases the pin 520 into either a retracted (e.g. non engaged position as shown in FIG. 9A) or an extended (e.g. engaged piercing position as shown in FIG. 9C). The spring can be an extension spring or a compression spring respectively. In other examples, no biasing is used and in other examples the biasing mechanism is located in other locations, e.g. between the flange 525 and the end 404).

In accordance with various embodiments, one or more of the couplers 200/300, distribution body 400, piercing mechanisms 500, articulation mechanism 600, or interlock mechanism 420 is formed from a polymer including any of a variety of plastics. One or more of these mechanisms and components can be plastic injection molded in accordance with the concepts provided herein as a person of ordinary skill in the art would understand from the disclosure here.

Figure 10:
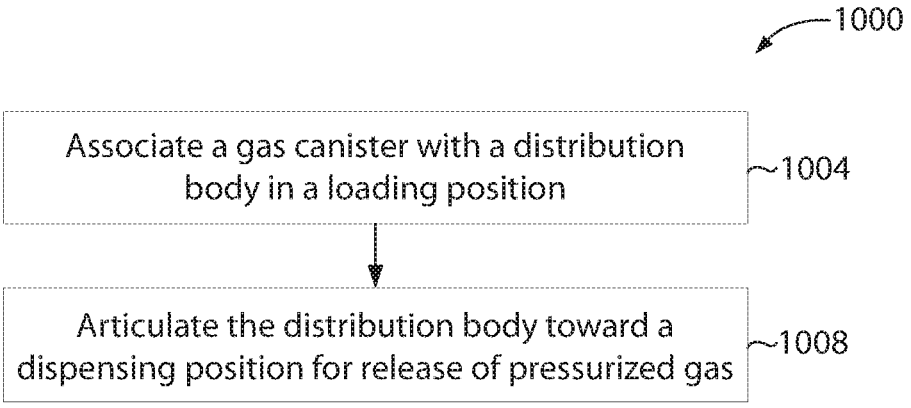
FIG. 10 is a flow diagram for installing a canister in a beverage machine.

To facilitate the reader's understanding of the various functionalities of the embodiments discussed herein, reference is now made to the flow diagram in FIG. 10, which illustrates process 1000. While specific steps (and orders of steps) of the methods presented herein have been illustrated and will be discussed, other methods (including more, fewer, or different steps than those illustrated) consistent with the teachings presented herein are also envisioned and encompassed with the present disclosure.

In this regard, with reference to FIG. 10, process 1000 relates generally to a method for installing a gas canister in a beverage machine. The process 1000 can be used with any of the beverage dispensing systems and gas dispensing systems described herein, for example, such as the beverage dispensing system 10 and the gas dispensing system 100.

At operation 1004, a gas canister can be associated with a distribution body in a loading position. For example and with reference to FIG. 4B, a gas canister 800 can be associated with a distribution body 400 in a loading position LP. The loading position LP can be arranged at an angle from a vertical orientation of the beverage appliance. For example, the loading position can be 30, 40, 50, 60 or more degrees from the vertical direction. This can allow a user to install the gas canister 800 at angle orientation allowing for ease of integration with the gas dispensing system 100. Further, the orientation of the loading position LP can also corresponding to a configuration in which a puncture mechanism is disengaged from or retracted form a portion of the distribution body that received the gas canister.

At operation 1008, the distribution body 400 can be articulated relative to an articulation mechanism that is generally fixed within the beverage machine. The articulation an move the gas canister into a dispensing position for release of pressurized gas held within the canister. For example and with reference with FIG. 4A, the distribution body 400 is shown articulated relative to the articulation mechanism 600. FIG. 4A further shows that the articulation of the distribution body 400 in this manner moves the gas canister 800 to a dispensing position DP. In the dispensing position DP, the gas dispensing system can operate to release pressurized gas from the gas canister 800 for use in the production of beverages.

For example and as described herein, a puncture mechanism (e.g., puncture mechanism 500 of FIG. 5) can includes a puncture element that is used to puncture the gas canister 800. In some embodiments, such as that shown and described with respect to FIGS. 9A-9D, the puncture element can be caused to slide into the distribution body 400 and toward the gas canister 800 in response to the articulation of the distribution body 400 relative to the articulation mechanism 600. When the distribution body 400 is fulling articulated in the dispensing position DP, the puncture element can be moved sufficiently far into the distribution body 400 so that the puncture element punctures the gas canister 800 for release of pressurized gas into the gas dispensing system 100.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is also to be understood that the terminology used herein is for the purpose of describing particular examples only, and is not intended to be limiting.

With respect to the use of substantially any plural or singular terms herein, those having skill in the art can translate from the plural to the singular or from the singular to the plural as is appropriate to the context or application. The various singular/plural permutations can be expressly set forth herein for sake of clarity. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, or A, B, and C together, etc.). It will be further understood by those within the art that virtually any disjunctive word or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably coupleable", to each other to achieve the desired functionality. Specific examples of operably couplable include but are not limited to physically mateable or physically interacting components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A gas dispensing system for a beverage machine, comprising:

an articulation mechanism configured to be fixed to the beverage machine;

a distribution body configured to direct the pressurized gas from a gas canister to the beverage machine, the distribution body engaged with the articulation mechanism for articulation between a loading position and a dispensing position; and a pressure interlock that limits articulation of the distribution body in response to a pressure above a pressure threshold;

wherein the gas dispensing system is configured to release pressurized gas from the gas canister when the distribution body is in the dispensing position.

2. The gas dispensing system of claim 1, wherein the distribution body defines a series of lumens, a first lumen of the series of lumens being configured to receive pressurized gas from the gas canister, and a second lumen of the series of lumens being configured to transfer pressurized gas from the distribution body and toward the beverage machine.

3. The gas dispensing system of claim 2, wherein the articulation mechanism defines a pivot axis and the distribution body is engaged with the articulation mechanism to pivot about the pivot axis.

4. The gas dispensing system of claim 3, wherein the second lumen is arranged substantially along the pivot axis and the first lumen extends substantially radially from the pivot axis.

5. The gas dispensing system of claim 2, wherein a third lumen of the series of lumens provides a visual indication of pressurization within the distribution body.

6. The gas dispensing system of claim 1, further comprising the gas canister releasably associated with the distribution body via a receiving coupler.

7. The gas dispensing system of claim 6, further comprising a puncture mechanism coupled with the distribution body and including a puncture element extending partially into the distribution body and substantially aligned with the gas canister.

8. The dispensing system of claim 7, wherein the puncture element is movable toward the gas canister in response to articulation of the distribution body from the loading position to the dispensing position.

9. The dispensing system of claim 8, wherein:

the articulation mechanism defines a cam path;

a portion of the puncture element extends from the distribution body, engaging the cam path; and articulation of the distribution body from the loading position to the dispensing position causes the portion of the puncture element to following the cam path, moving the puncture element toward the gas canister.

10. A gas dispensing system for a beverage machine, comprising:

a gas canister configured to release pressurized gas into the gas dispensing system;

a distribution body defining a receiving coupler for releasably associating the distribution body to the gas canister, the distribution body configured to articulate between a loading position and a dispensing position and maintaining the association of the gas canister;

an engagement coupler connected to the gas canister, the engagement coupler and the receiving coupler cooperating to establish a sealed connection between the gas canister and the distribution body;

a collet disposed between the receiving coupler and the distribution body, wherein the collet aligns the engagement coupler, the receiving coupler and the distribution body; and a puncture mechanism coupled with the distribution body and configured to puncture the gas canister in response to the gas canister being in the dispensing position.

11. The system of claim 10, wherein the receiving coupler defines threads configured to thread the gas canister and the distribution body to one another.

12. The system of claim 10, wherein:

the gas canister releases pressurized gas into the distribution body in response to being punctured by the puncture mechanism; and the system further comprises a valve fluidically connected with the distribution body and configured to regulate flow of the pressurized gas into the beverage machine.

13. The system of claim 12, wherein:

the distribution body and the valve are fluidically connected at a lumen; and the distribution body is configured to pivot about an axis substantially defined by the lumen.

14. The system of claim 13, wherein:

the system further comprises an articulation mechanism defining a series of apertures;

the distribution body comprises a series of protrusions, each extending through respective ones of the series of apertures; and the series of apertures and the series of protrusions cooperate to establish the articulation of the distribution body between the loading position and the dispensing position.

* * * * *